US005706582A

United States Patent [19]

Hosokawa et al.

[11] Patent Number: 5,706,582

[45] Date of Patent: Jan. 13, 1998

[54] DRY SHAVER WITH A SKIN STRETCHER

[75] Inventors: Shin Hosokawa; Toshio Ikuta; Masao Tanahashi, all of Hikone, Japan

[73] Assignee: Matsushita Electric Works, Ltd., Osaka, Japan

[21] Appl. No.: 605,998

[22] Filed: Feb. 23, 1996

[30] Foreign Application Priority Data

Feb. 23, 1995 [JP] Japan ..... 7-035719

[51] Int. Cl.[6] ..... B26B 19/42

[52] U.S. Cl. ..... 30/34.2; 30/43.92

[58] Field of Search ..... 30/34.2, 43.92, 30/43.9, 43.6

[56] References Cited

U.S. PATENT DOCUMENTS

| | | | |
|---|---|---|---|
| 2,670,534 | 3/1954 | Haber . | |
| 5,249,361 | 10/1993 | Aprille et al. | 30/34.2 X |
| 5,398,412 | 3/1995 | Tanahashi et al. . | |

FOREIGN PATENT DOCUMENTS

| | | | |
|---|---|---|---|
| 4313371 | 10/1993 | Germany . | |
| 4312060 | 6/1994 | Germany . | |
| 63-121072 | 7/1985 | Japan . | |
| 5-560063 U | 7/1993 | Japan . | |
| 5-56063 | 7/1993 | Japan . | |
| 811207 | 4/1959 | United Kingdom | 30/34.2 |

OTHER PUBLICATIONS

European Search Report, Apr. 23, 1996, 2 pages.

*Primary Examiner*—Douglas D. Watts

[57] ABSTRACT

A dry shaver with a skin stretcher comprises a shaver body and a shaving head mounted on top of the shaver body. The shaving head comprises at least one cutter unit with a perforated outer cutter. An inner cutter is driven to move in hair shearing engagement with the outer cutter. The skin stretcher comprises a skin contact elongated along the periphery of the outer cutter and a base through which the skin contact is held on the shaving head. A macro displacement structure is provided to allow the skin contact to be movable within a macro displacement range relative to the shaver body. The skin contact is made from an elastic material capable of being elastically deformed within a micro displacement range relative to the base. With the combination of the macro and micro displacements of the skin contact, the skin contact can be kept in contact with the skin of a user in conformity with various contours of the skin. Thus, the skin stretcher can stretch a large portion of the skin even with an uneven skin surface, i.e., around the chin or the like to raise the hairs over a wide area prior to the shaving by the cutter unit, thereby assuring smooth and effective hair shaving at the cutter unit.

4 Claims, 27 Drawing Sheets

20B
21B
26B
21B
54
55
54
55
3B 251
250
230
231
202
276
232
270
236
234
274
276
270
271
261
262
274
260
237
237
263
222
265
221

224
222
220
223
221
225
245
241
240
242
246
204
203
204
201
203
210
205
206

DRY SHAVER WITH A SKIN STRETCHER

BACKGROUND OF THE INVENTION

1. Field of the Invention

The present invention is directed to a dry shaver with a skin stretcher for raising hairs prior to cutting the hairs for effective hair cutting.

2. Description of the Prior Art

Dry shavers with a skin stretcher have been proposed in the following publications.

1) Japanese Utility Model Publication (KOKAI) No. 63-121072

2) Japanese Utility Model Publication (KOKAI) No. 5-56063

The dry shaver according to the above publication 1) includes a skin stretcher in the form of a probe extending in an adjacent relation to a cutter unit. The probe comes into contact with the skin in advance of the cutter unit while moving the cutter unit across the skin of a user so as to stretch the skin for raising the hairs to be subsequently fed into perforations of an outer cutter, thereby improving cutting efficiency. The dry shaver according to the above publication 2) includes a skin stretcher in the form of a guide plate having an elongated skin contact edge. The guide plate extends in an adjacent relation to a cutter unit and is floatingly supported to a shaver body so that the guide plate is kept pressed against the skin during the shaving, thereby raising the hairs for readily introducing the hairs into the perforations of the outer cutter. The dry shaver of the latter publication is found advantageous in that the skin stretcher can be kept pressed against the skin to thereby press the skin constantly during the shaving operation. However, in an actual shaving condition where the cutter unit is required to move across uneven skin surface, i.e., around a chin, only a portion of the elongate contact edge is available for stretching the skin. Thus, the hair raising is only effective to a limited portion and therefore not sufficient for smooth shaving.

SUMMARY OF THE INVENTION

The present invention has been accomplished to reduce the above problem and assure effective shaving in cooperation with the use of a movable cutter unit. The dry shaver in accordance with the present invention comprises a shaver body and a shaving head mounted on top of the shaver body. The shaving head comprises at least one cutter unit with a perforated outer cutter. An inner cutter is driven to move in hair shearing engagement with the outer cutter. The skin stretcher comprises a skin contact means elongated along the periphery of the outer cutter and a base through which the skin contact means is held on the shaving head. A macro displacement structure is provided to allow the skin contact means to be movable within a macro displacement range relative to the shaver body. The skin contact means is made from an elastic material capable of being elastically deformed within a micro displacement range relative to the base. With the combination of the macro and micro displacements of the skin contact means, the skin contact means can be kept in contact with the skin of a user in conformity with various contours of the skin. Thus, the skin stretcher can stretch a large portion of the skin even in an uneven skin surface, i.e., around the chin or the like to raise the hairs over a wide area prior to the shaving by the cutter unit, thereby assuring smooth and effective hair shaving at the cutter unit.

Accordingly, it is a primary object of the present invention to provide a dry shaver which is capable of effectively shaving the hairs over a wide area of the skin with the assistance of the hair stretcher.

In a preferred embodiment, the skin contact means comprises a plurality of parallel elastic fins extending along the periphery of the outer cutter. The elastic fins are spaced in a direction perpendicular to the periphery of the outer cutter and therefore in a direction along which the shaving head is manipulated to move. Thus, the elastic fins are cooperative to raise the hairs successively while advancing the cutter unit in that direction, thereby successfully raise the hairs for improved shaving effect, which is therefore another object of the present invention.

The elastic fin located nearer to the outer cutter has its upper end which is higher than the fin located away from the outer cutter so that the tips of the elastic fins are cooperative to form an inclined envelop for smooth and effective contact with the skin. The elastic fins may project at different angles from one another so as to form therebetween uniform gaps so that clipped hairs trapped in the gap can be removed with equal readiness.

The skin contact means may be made to exhibit a greater resistance when the shaving head is advanced across the skin of the user with the skin stretcher positioned forward of the outer cutter than when it is advanced with the skin stretcher behind said outer cutter. With this arrangement, the skin stretcher when located behind the cutter unit during the shaving operation does not act to impede the movement of the inner cutter over the skin of the user.

In a preferred embodiment of the present invention, the shaving head includes a head frame which is mounted on top of the shaver body. The skin stretcher is floatingly supported to the head frame so as to be movable relative to the cutter unit. With this result, the skin stretcher is allowed to move independently of the cutter unit while advancing the shaving head across various portions of the skin, thereby enhancing hair rising and shaving effect over the wide area of the uneven skin surface.

In another embodiment, the skin stretcher is floatingly supported to the cutter unit which is also floatingly supported to the head frame so that the skin stretcher is movable independently of the movable cutter unit within a limited extent. Whereby, the skin stretcher can be depressed alone and be thereafter depressed further together with the cutter unit. Whereby, the skin stretcher can be constantly brought into contact against the skin simultaneously with the cutter unit for effective hair raising and shaving.

The cutter unit includes a holder carrying the outer cutter. The holder is molded to have an integral spring member which is connected to floatingly support the skin stretcher. Thus, the skin stretcher is held movable relative to the outer cutter without requiring a separate spring member.

The skin stretcher includes the base by which the skin stretcher is mounted to the shaving head. The skin stretcher itself may have a spring member to make the skin contact means movable. For this purpose, the spring member is molded integrally with the skin contact means and the base for movably supporting the skin contact means relative to the base, i.e., the head frame or the cutter unit to which said base is mounted. Thus, no additional spring member is required for the shaving head to reduce the number of components.

In a further embodiment, the skin stretcher is floatingly supported to the cutter unit by a first spring, while the cutter unit is floatingly supported to the head frame by a second spring. Thus, at least one of the first and second springs defines the macro displacement structure to allow the skin contact means to be movable relative to the head frame and therefore to the shaver body. Since, the skin contact is movable relative to the cutter unit, the skin contact means can be depressed relative to the cutter unit for effective hair raising and shaving.

Alternately, the skin stretcher may be pivotally supported to the head frame to be swingable about an axis parallel to the longitudinal axis of the cutter unit. The skin stretcher can swing dependent upon an angle at which the shaving head is pressed against the skin, so that the skin contact means can be kept into contact with the skin at a suitable pressure for effective hair raising and shaving.

In an embodiment where the skin contact means comprises a plurality of parallel fins of the same length which project in the same direction from an upper end face of a header, the upper end face is inclined such that the fin nearer to the adjacent outer cutter has its tip at an height greater than that of the fin far from the outer cutter. With this simple structure, the skin stretcher can give a greater resistance when the shaving head is advanced across the skin with the skin stretcher positioned forward of the outer cutter than when it is advanced with the skin stretcher behind said outer cutter.

In a further embodiment of the present invention where the outer cutter of the cutter unit is of a circular configuration, the skin stretcher is of an annular configuration surrounding the outer cutter so that the hair rising is available for any direction in which the cutter unit is advanced across the skin.

A still further embodiment of the present invention discloses an arrangement in which the skin stretcher is mounted on the shaving head which is pivotally supported to the shaver body. The cutter unit of the shaving head has the outer cutter which is elongated to have a longitudinal axis. The shaving head is pivotable about an axis parallel to the longitudinal axis to be swingable together with the skin stretcher within a limited angular range. Thus, a macro displacement structure is realized by the pivot support for allowing the skin stretcher to move within the macro displacement range, i.e., the limited angular range relative to the shaver body. Therefore, the skin stretcher and the cutter unit can be pressed together against the skin at a suitable angle depending upon a portion of the skin for effective hair raising and shaving.

The shaving head includes a head frame which is pivotally supported to the shaver body and fixedly carries the cutter unit. The skin stretcher may be floatingly supported to the head frame to be movable relative to the cutter unit so that the skin stretcher can be pressed at a suitable pressure against the skin, in addition to being pressed at an optimum angle together with the cutter unit for enhanced hair raising and shaving.

Preferably, the swingable shaving head carries a pair of elongated cutter units. The skin stretcher may be located on the outer side of each cutter unit or between the opposed cutter units. When the skin stretcher is located between the cutter units, the skin stretcher may be made swingable about an axis parallel to the longitudinal axis of the cutter unit.

These and still other objects and advantages will become more apparent from the following detailed description of the embodiments when taken in conjunction with the attached drawings.

DETAILED DESCRIPTION OF THE EMBODIMENTS

First Embodiment <FIGS. 1 to 6>

Figure 1:
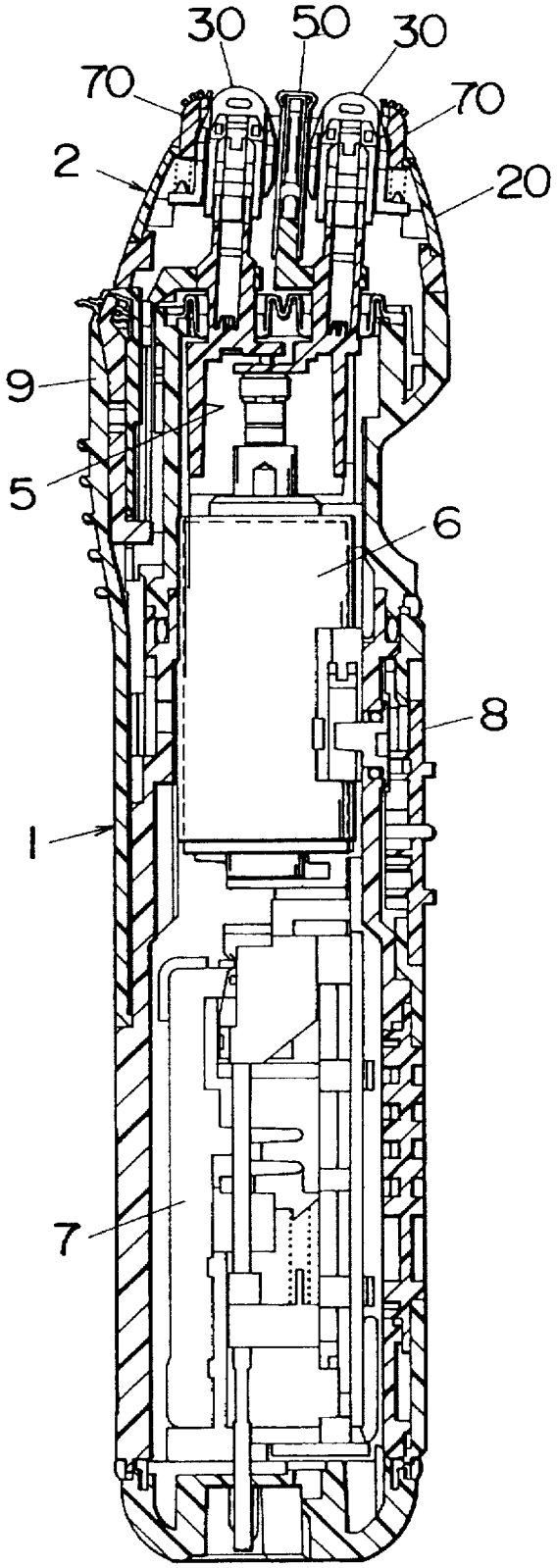
FIG. 1 is a vertical section of a dry shaver in accordance with a first embodiment of the present invention.
Figure 3:
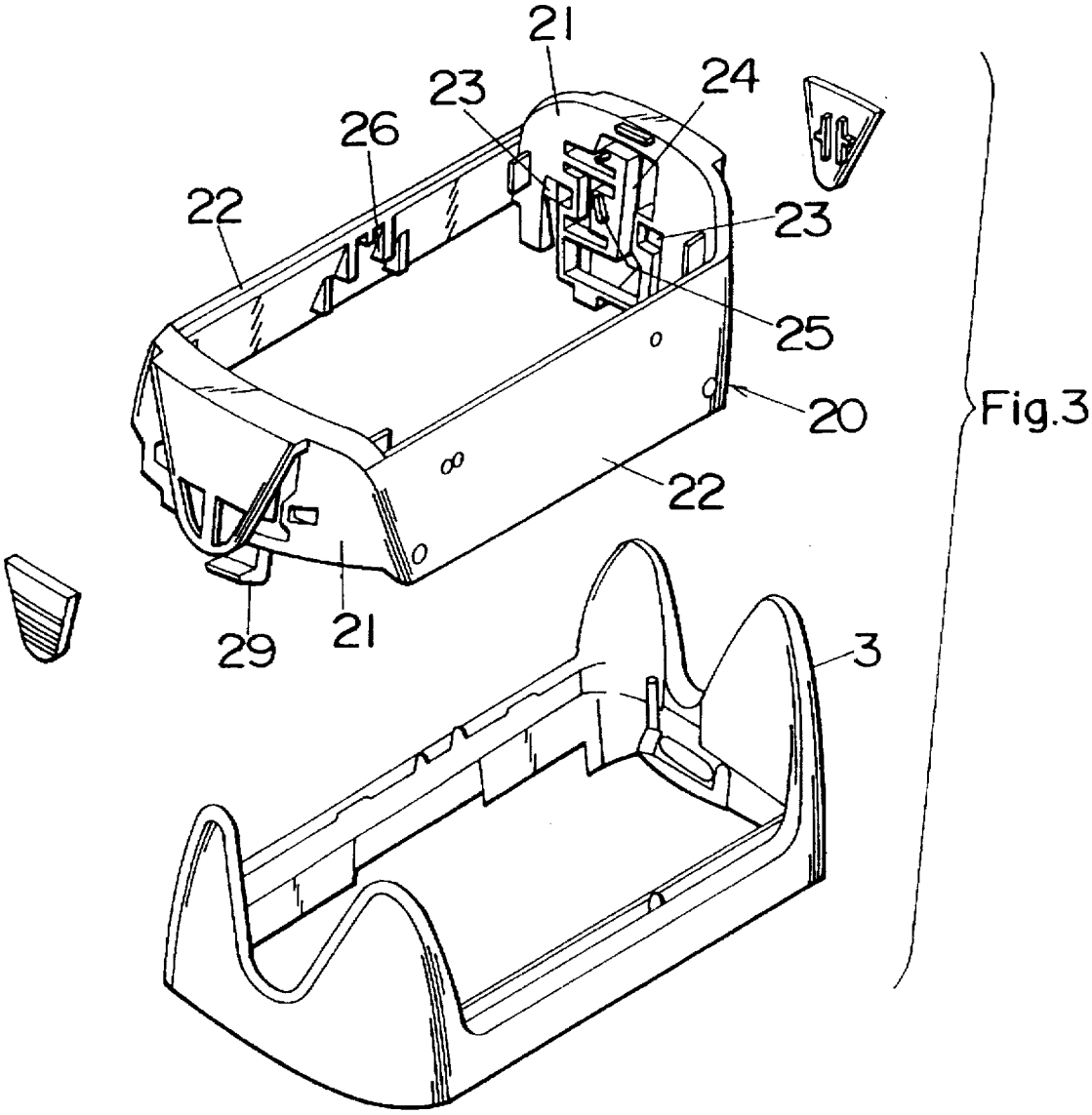
FIG. 3 is an exploded perspective view of the shaving head.

Referring now to FIG. 1, there is shown a reciprocatory dry shaver in accordance with a first embodiment of the present invention. The shaver comprises a shaver body 1 mounting thereon a shaving head 2 having a pair of first cutter units 30 and a second cutter unit 50 disposed between the first cutter units. Each of the first cutter units 30 is provided for cutting relatively short hairs, while the second cutter unit 50 is for cutting relatively long hairs to short hairs to be subsequently cut by the cutter unit 30. As shown in FIG. 3, the shaving head 2 comprises a head frame 20 detachably mounted to a head support 3 provided on top of the shaver body 1. The head frame 20 is in the form of a rectangular chassis made of a rigid plastic material to have opposed end wails 21 integrally connected by opposed side walls 22. A hook 29 is provided at each of the end walls 21 for detachable engagement with the head support 3.

Figure 4:
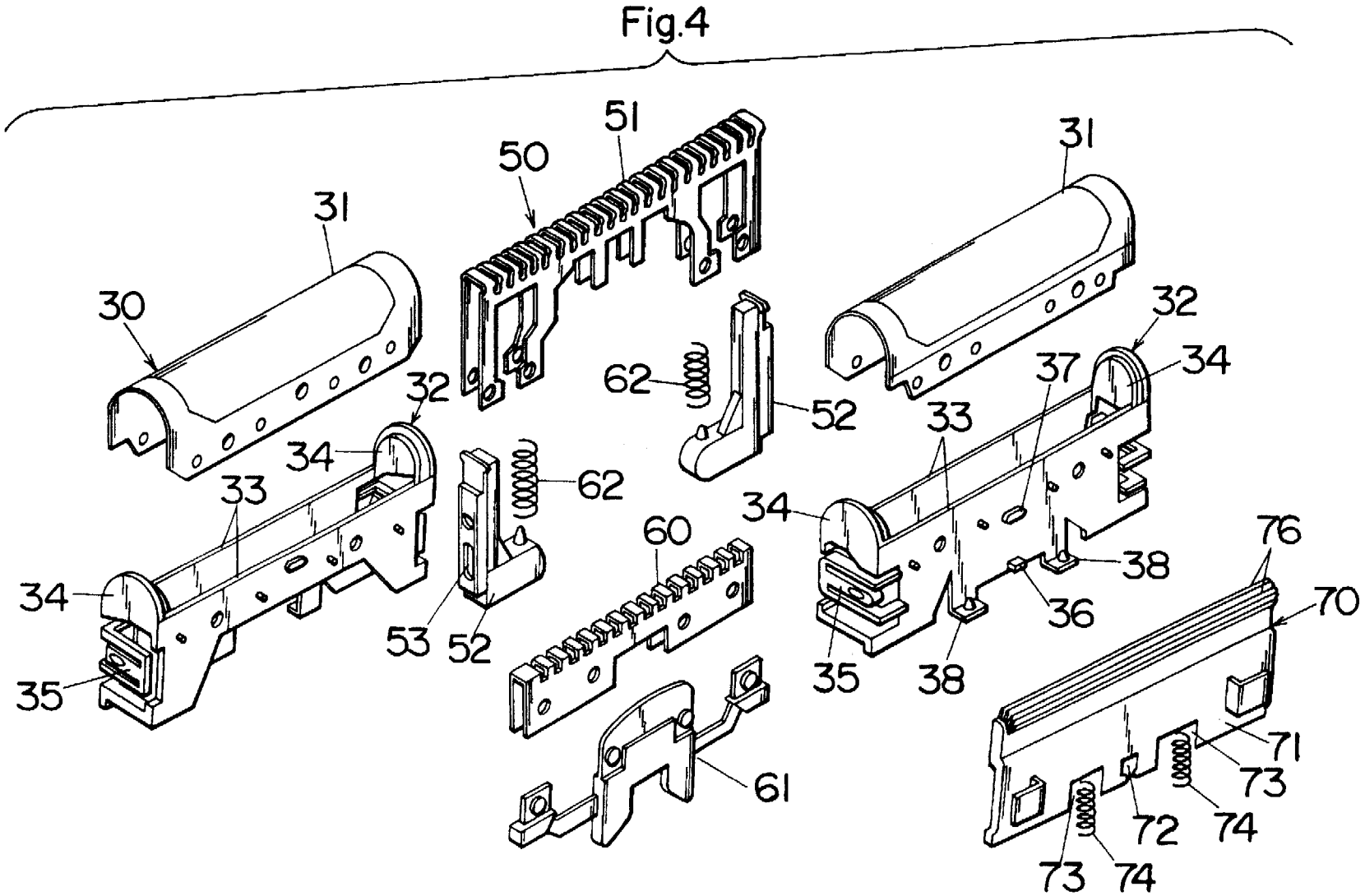
FIG. 4 is an exploded perspective view of cutter units and a skin stretcher mounted to the shaving head.

As shown in FIG. 4, the first cutter unit 30 comprises an elongated outer cutter in the form of a shearing foil 31 which is curved into a generally U-shaped configuration to have an apex extending longitudinally of the cutter unit 30 to define a longitudinal axis for the outer cutter 31, i.e., the first cutter unit 30. The outer cutter 31 is held on a rectangular holder 32 with the opposite lower ends of the outer cutter 31 coupled to opposite side wall 33 of the holder 32. The holder 32 has opposite end walls 34 which is molded to integrally have a resilient beam 35 by which the holder 32 is supported to the head frame 20 so that the cutter unit 30 is floatingly supported to be movable relative to the head frame 20. To this end, the resilient beam 35 has a projection which is fitted into a corresponding cavity 23 in an end wall 21 of the head frame 20.

The second cutter unit 50 comprises a narrow stationary outer cutter 51 with a number of longitudinally spaced slits. The outer cutter 51 is secured at opposed longitudinal ends by L-shaped supports 52 which are connected respectively to resilient elements 24 formed integrally in the end wall 21 of the head frame 20 so that the outer cutter 51 is floatingly supported to be movable relative to the head frame 20. The connection is made by engagement of projections 25 on the resilient elements 24 into holes 53 in the supports 52.

Figure 5:
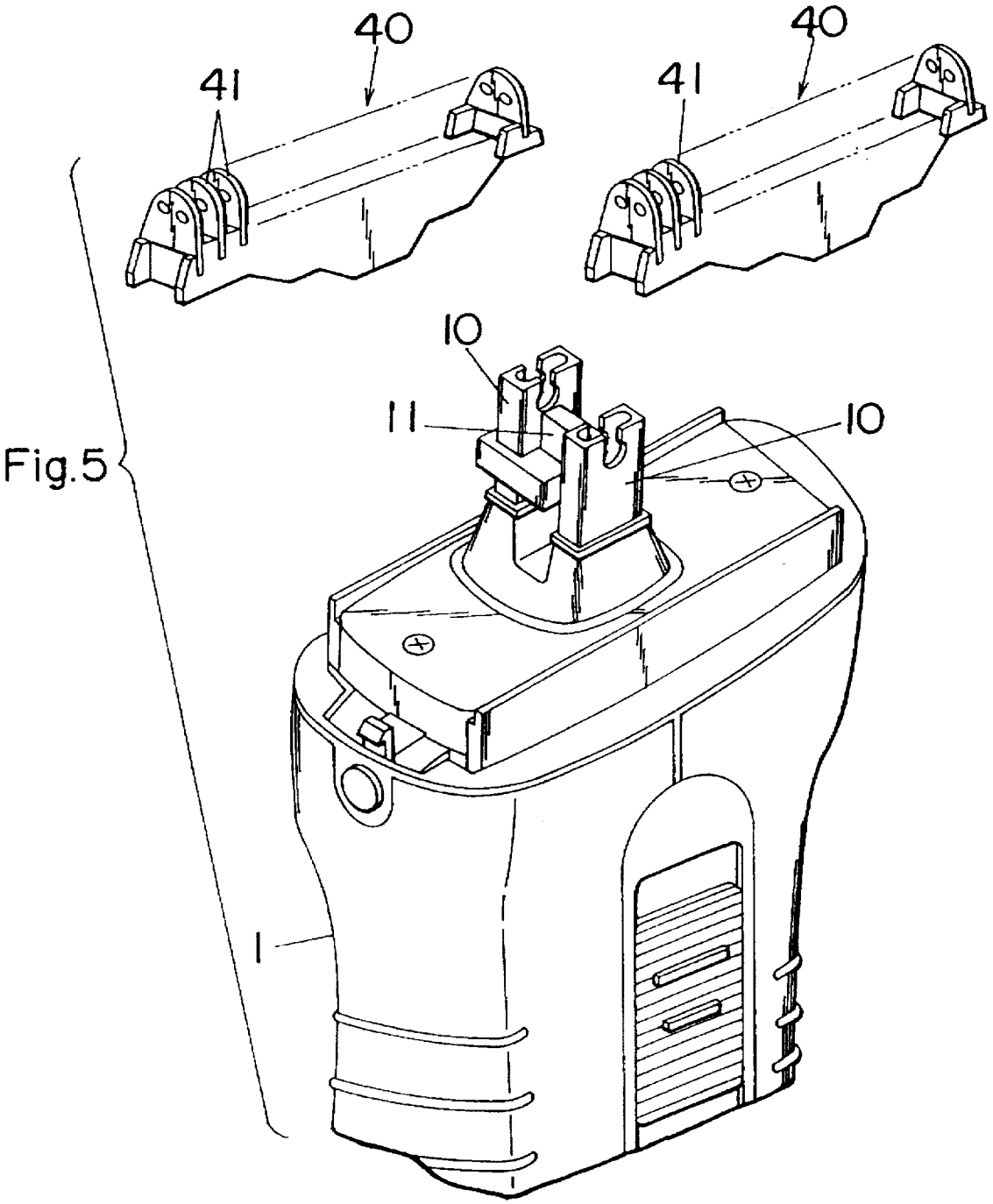
FIG. 5 is an exploded perspective view of a shaver body and inner cutters of the above dry shaver.

As shown in FIG. 5, a pair of first inner cutters 40 project on the top of the shaver body 1 for hair shearing engagement respectively with the outer cutters 31 of the first cutter unit 30. Each of the inner cutters 40 comprises a number of arcuately contoured blades 41 and is coupled respectively to reciprocating drive pins 10 projecting on top of the shaver body 1 so as to be driven thereby in a counter reciprocating manner. The drive pins 10 are coupled to rotary-to-reciprocation conversion elements 5 which are received within the shaver body 1 and are driven by an incorporated electric motor 6 to reciprocate in opposite direction to each other. The inner cutters 40 are biased upwardly by means of springs 43 provided at the connection of the drive pins 10 to the inner cutters 40, respectively in order to develop a suitable contacting pressure between the inner cutter 40 and the outer cutter 31. The motor 6 is energized by an incorporated battery 7 and is turned on and off by an operation of a switch handle 8 slidably mounted on the front face of the shaver body 1. A vertical slidable trimmer 9 is provided on the rear face of the shaver body 1 to be utilized independently or in cooperation with the shaving head 2.

A second inner cutter 60 is held movable relative to the outer cutter 51 and is connected through a coupler 61 to a joint 11 integral with one of the drive pins 10 so as to be driven thereby to reciprocate together with one of the inner cutters 40. Coil springs 62 are provided to urge the inner cutter 60 against the outer cutter 51 to give a suitable contacting pressure therebetween. The inner cutter 60 is movably held on the L-shaped supports 52 and is therefore held on the head frame 20. It is noted in this connection that the head frame 20 is assembled into a unitary structure including the cutter units 30 and 50 and the inner cutter 60 and is detachable to the head support 3 as a single replacement part. Each of the first cutter unit 30 is floatingly supported to the head frame 20 so as to be capable of being depressed against the biases of the resilient beams 35 and of the spring 43, while the second cutter unit 50 is floatingly supported to the head frame 20 to be capable of being depressed against the bias of the resilient element 24. The above floating mechanism is substantially identical to that disclosed in the U.S. Pat. No. 5,398,412.

Mounted adjacent to the first cutter units 30 are a pair of skin stretchers 70 which, in use, come into contact with the skin of a user to stretch the skin, thereby raising the hairs to be readily fed into the perforations of the outer cutters 31 for enhancing shaving efficiency. As shown in FIG. 4, each of the skin stretcher 70 comprises a base 71 of a hard plastic and a skin contact means 76 of an elastic material which are molded integrally into a single member extending substantially the full length of the outer cutter 31. For example, the elastic material is an elastomer of urethane, ethylene, or polyvynl-chrolide, and the hard plastic is ABS resin or nylon. The skin contact means of elastic material has a coefficient of friction greater than the base of the hard material so that the skin contact means can trap the hairs easily due-to greater friction coefficient, while the base is easy to be mounted to the shaver body due to its rigidity.

Figure 6:
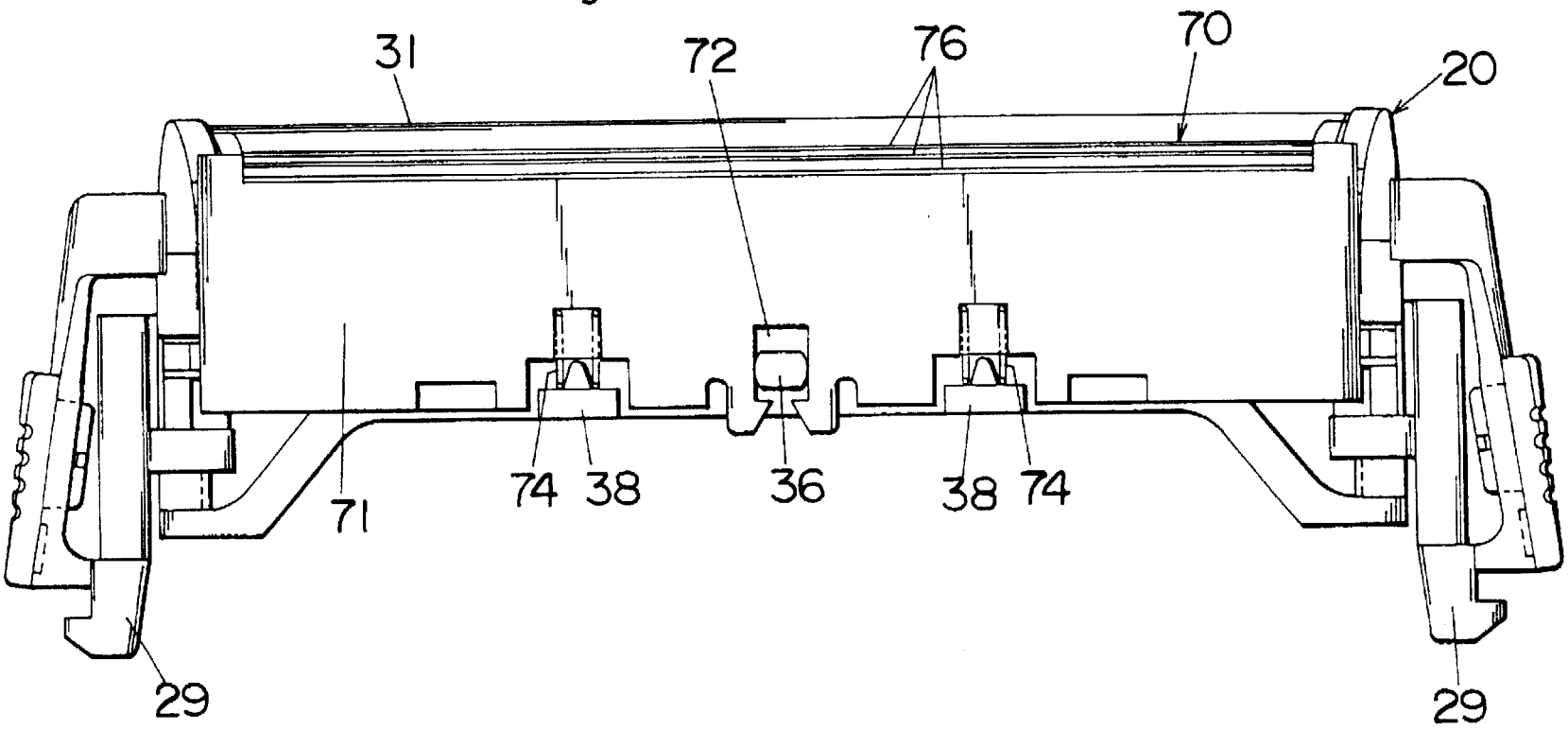
FIG. 6 is a front view illustrating the skin stretcher mounted to a head frame with a portion of the head frame removed.

The base 71 is movably supported to the holder 32 of the cutter unit 30 to be movable relative to the cutter unit 30 and to the head frame 20. For this purpose, the side wall 33 of the holder 32 is formed at its lower end with a center stud 36 which extends loosely through a vertical slot 72 at the lower center of the base 71, as best shown in FIG. 6. The engagement of the stud 36 into the slot 72 is such that the skin stretcher 70 is movable vertically but not horizontally relative to the holder 32. The stud 36 extending through the skin stretcher 70 engages loosely into a vertical guide groove 26 formed in the side wall of the head frame 20 for guiding the vertical movement of the cutter unit 30.

The skin stretcher 70 is urged upward by springs 74 received in recesses 73 in the lower end of the base 71 and held between the upper end of the recesses 73 and ledges 38 at the lower end of the holder 32. Thus, the skin stretcher 70 is floatingly supported to the cutter unit 30 and is movable independently of and together with the cutter unit 30. Therefore, the skin stretcher 70 is allowed to have a macro displacement relative to the head frame 20, i.e., the shaver body 1 by the springs 74 and/or the resilient beam 35 of the holder 32, while the skin contact means 76 themselves are responsible for micro displacement for constant contact with the skin. The bias of springs 74 is selected to be less than the bias for urging the cutter unit 30 by the resilient beam 35 and the spring 43 associated with the inner cutter 40 so that, when the shaving head is pressed against the skin, the skin stretcher 70 is easier to be depressed than the cutter unit 30 for making an effective skin stretch. A post 37 is formed on the side wall 33 of the holder 32 upwardly of the stud 36 and abuts against the back of the base 71 for keeping a certain gap between the outer cutter 31 and the skin contact means 76.

Figure 2:
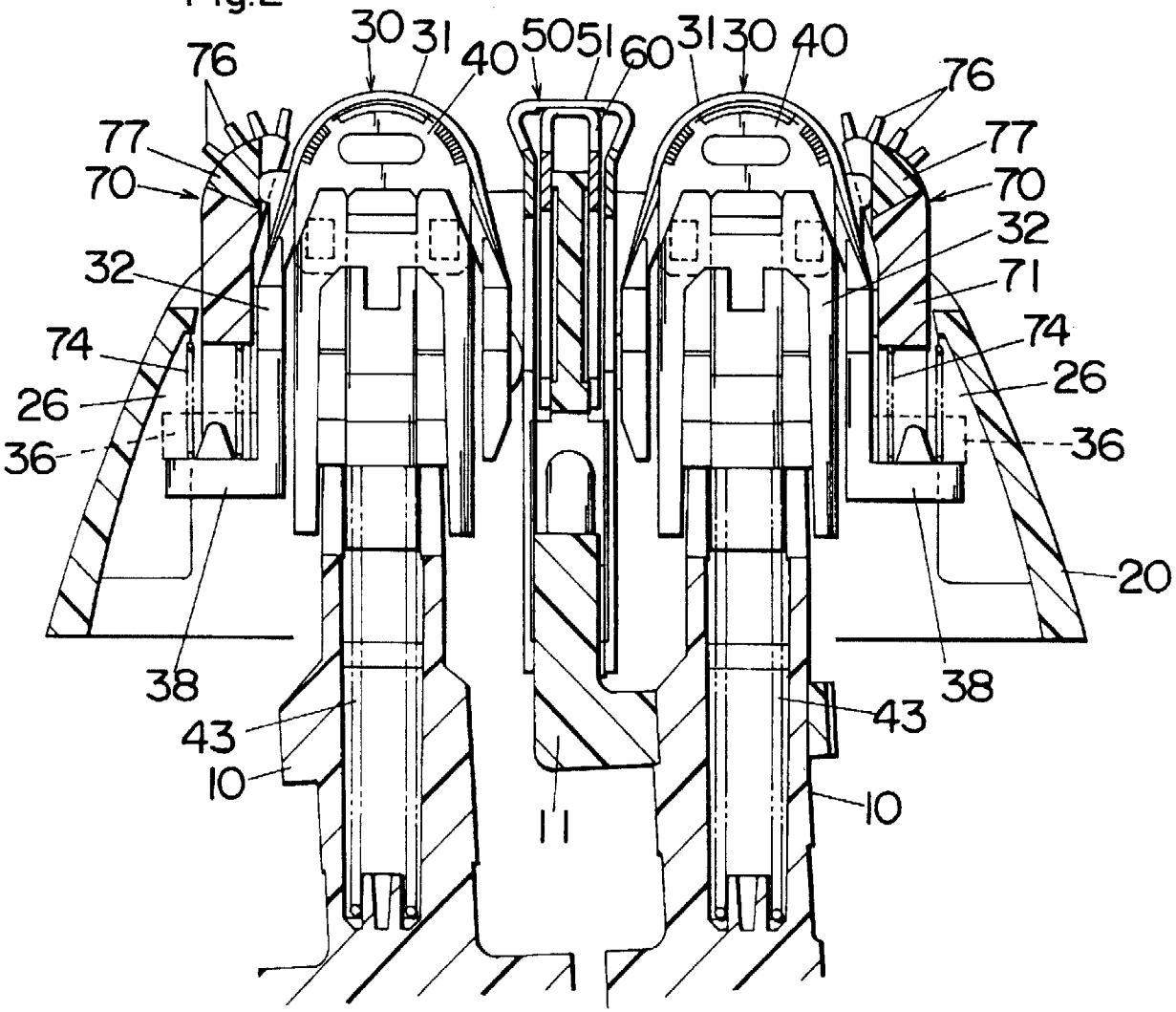
FIG. 2 is an enlarged section of a shaving head of the dry shaver.

The skin contact 76 comprises a plurality of elastic fins extending substantially the full length of the outer cutter 31 and arranged in spaced relation. As shown in FIG. 2, the fins 76 project from a header 77 at different angles so that the upper edges of the fins are cooperative to form an arcuate contour or envelop and that the fin 76 nearer to the outer cutter 31 has its upper edge at a higher level than the fin 76 away from the outer cutter 31. With this arrangement, the fins 76 can give a greater resistance against the skin when the shaving head is moved with the skin stretcher 70 in advance of the cutter unit 30 than when it is moved with the skin stretcher 70 behind the cutter unit. Although the above embodiment discloses the skin stretcher 70 molded from different materials, the entire skin stretcher may be molded from the elastomer or the like soft material. The skin stretcher molded solely from the elastomer may apply equally to the following modifications and embodiments.

Modification of the First Embodiment

Figure 7:
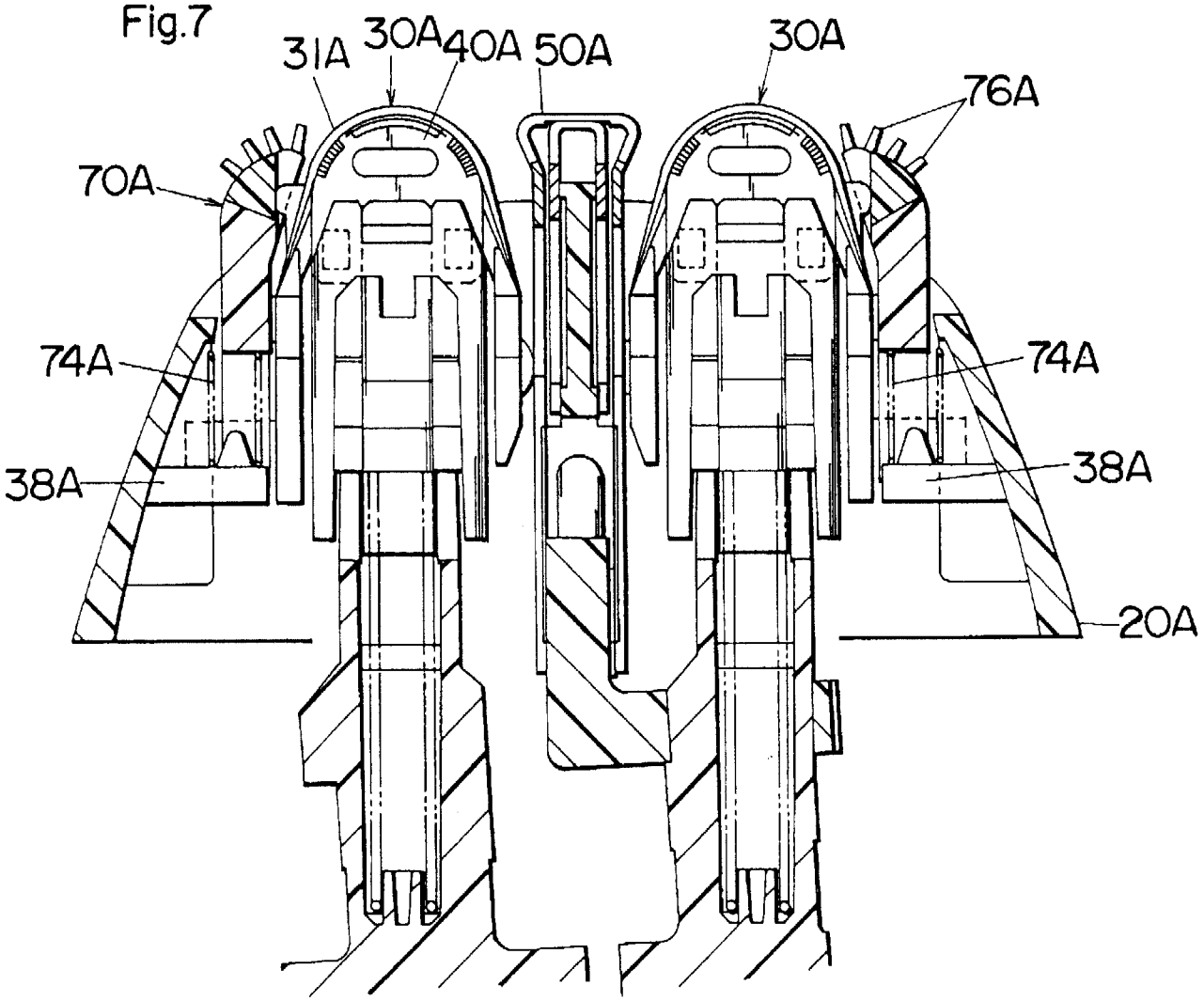
FIG. 7 is a sectional view similar to FIG. 2 but illustrates a modification of the first embodiment.
Figure 8:
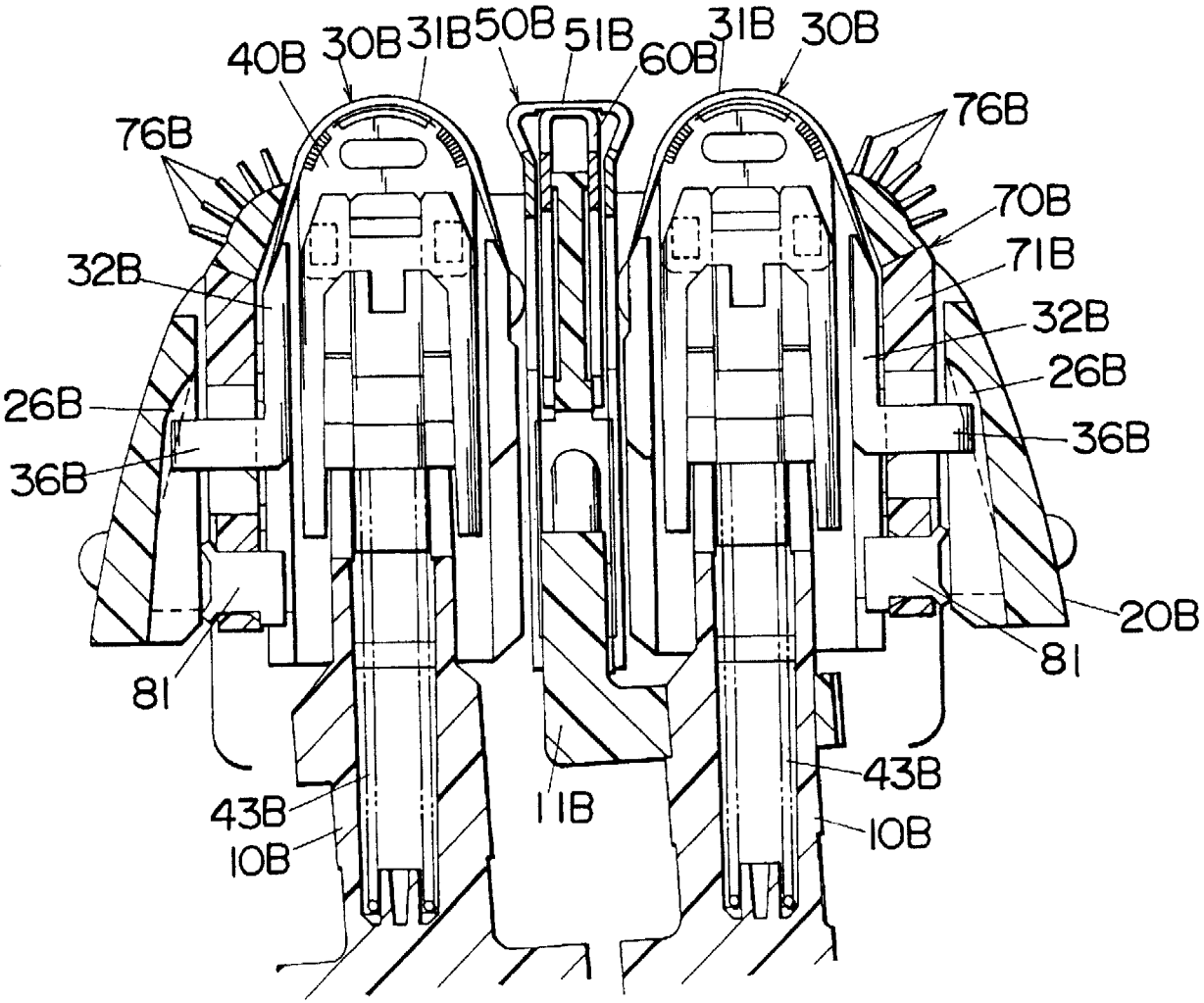
FIG. 8 is an vertical section illustrating a shaving head of a dry shaver in accordance with a second embodiment of the present invention.

Although the above embodiment illustrates that skin stretcher 70 which is movably held on the cutter unit 30, the skin stretcher 70A may be movably held to the head frame 20A by the use of the same springs 74A, as shown in FIG. 7, in which the head frame 20A has like ledges 38A for receiving the lower ends of the springs 74A. Like parts are designated by like numerals with a suffix letter of "A".

Second Embodiment <FIGS. 8 to 12>

Figure 10:
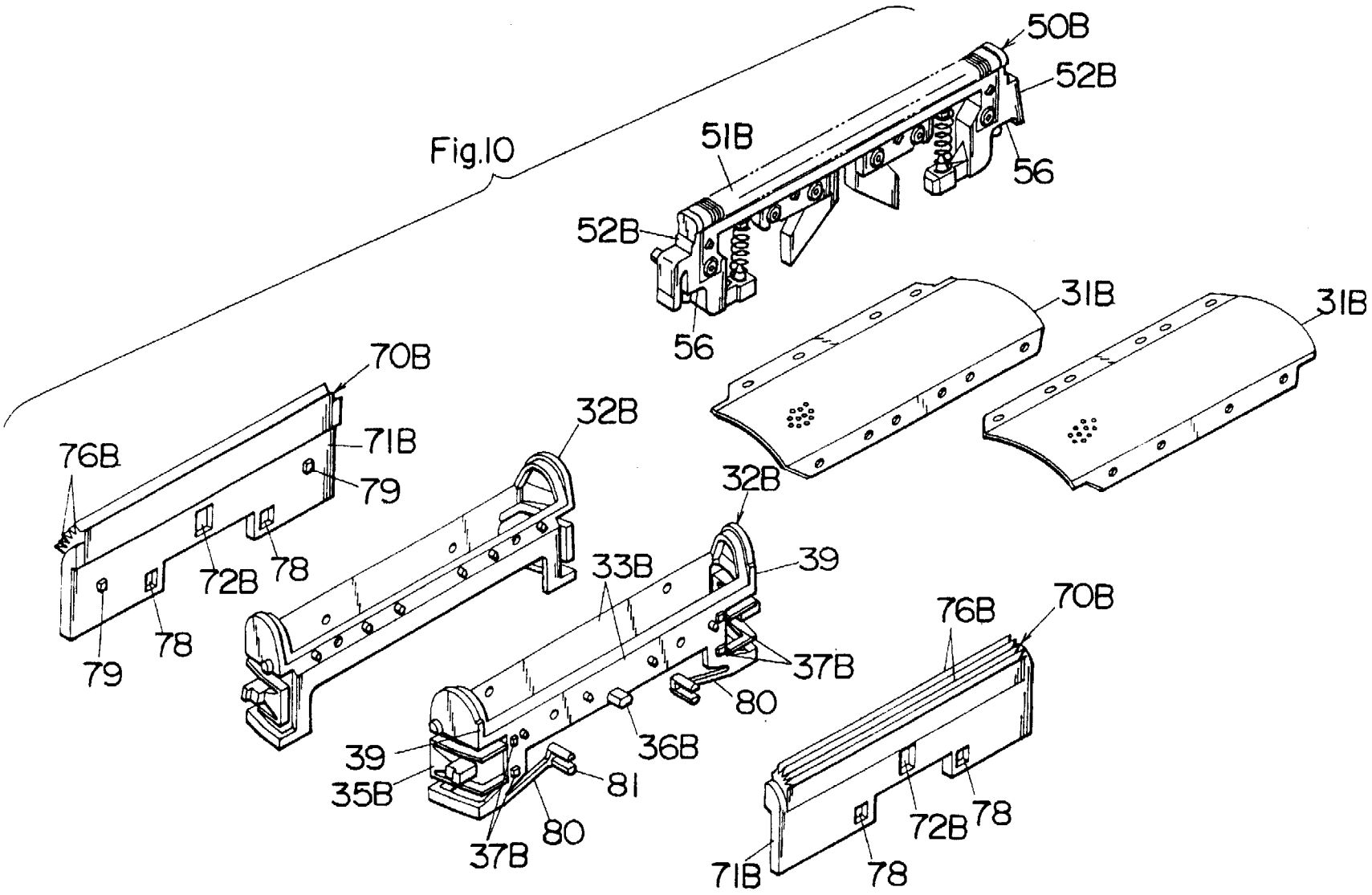
FIG. 10 is an exploded perspective view of the cutter units and skin stretchers mounted to the shaving head.
Figure 11:
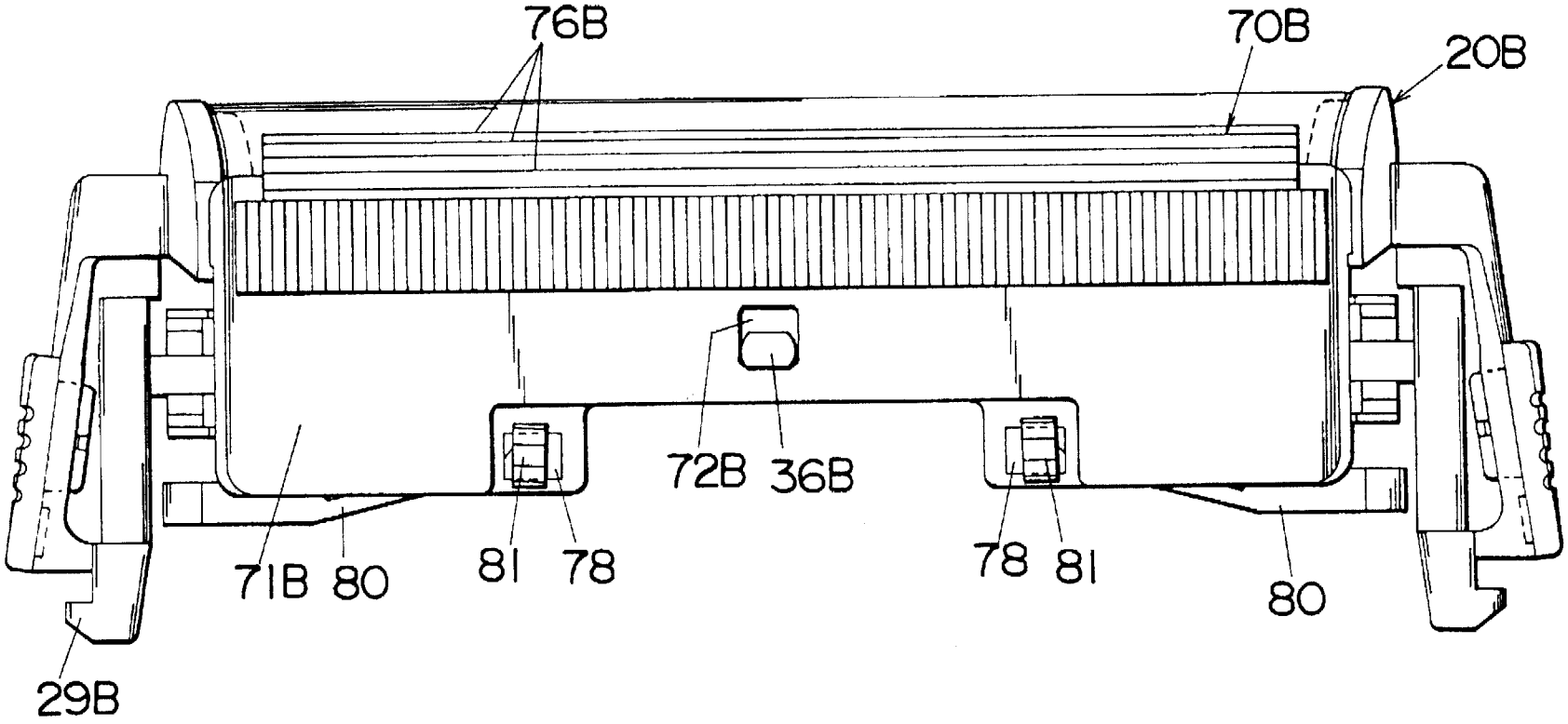
FIG. 11 is a front view illustrating the skin stretcher mounted to the shaving head with a portion of the head frame removed.

A second embodiment of the present invention is similar to the first embodiment except particularly that a like skin stretcher 70B is movably supported to an associated cutter unit 30B by springs 80 formed as integral parts of the holder 32B. Like parts are designated by like numerals with a suffix letter of "B". As shown in FIG. 10, a like holder 32B includes a pair of resilient beams which define the integral springs 80. The beams 80 extend from the opposite longitudinal ends of the side wall 33B within the thickness thereof and are formed at their opposed inner ends with outwardly projecting hooks 81. The hooks 81 are inserted into corresponding holes 78 and secured thereto to floatingly support the skin stretcher 70B to the holder 32B, i.e., the cutter unit 30B. A stud 36B projects from the side wall 33B of the holder 32B and extends through a vertical slot 72B into a guide groove 26B so that the skin stretcher 70B is vertically guided between an upper position where the stud 36B abuts against the lower edge of the slot 72B and a lower position where the stud 36B abuts against the upper edge of the slot 72B. In the absence of an external depressive force, the skin stretcher 70B takes the upper position, as shown in FIG. 11 and is depressed from this position during the use. In the like manner as in the first embodiment, the skin stretcher 70B is vertically guided between the holder 32B and the side wall of the head frame 20B without causing substantial jerky movement in the direction towards and away from the cutter unit 30B.

The base 71B of the skin stretcher 70B is formed on its back with a pair of longitudinally spaced projections 79 each of which abuts against the side wall 33B of the holder 32B between a vertically spaced pair of posts 37B on the side wall 33B. Thus, the skin stretcher 70B is allowed to be inclined with respect to an longitudinal axis of the cutter unit 30B until the projection 79 is engaged with either of the posts 37B. A pair of piers 39 are formed on opposite end of the side wall 33B of the holder 32B for abutment against the longitudinal ends of the skin stretcher 70B so as to give a predetermined clearance between the outer cutter 31B and the fin 76B for preventing the fin 76B from interfering with the outer cutter 31B.

Figure 9:
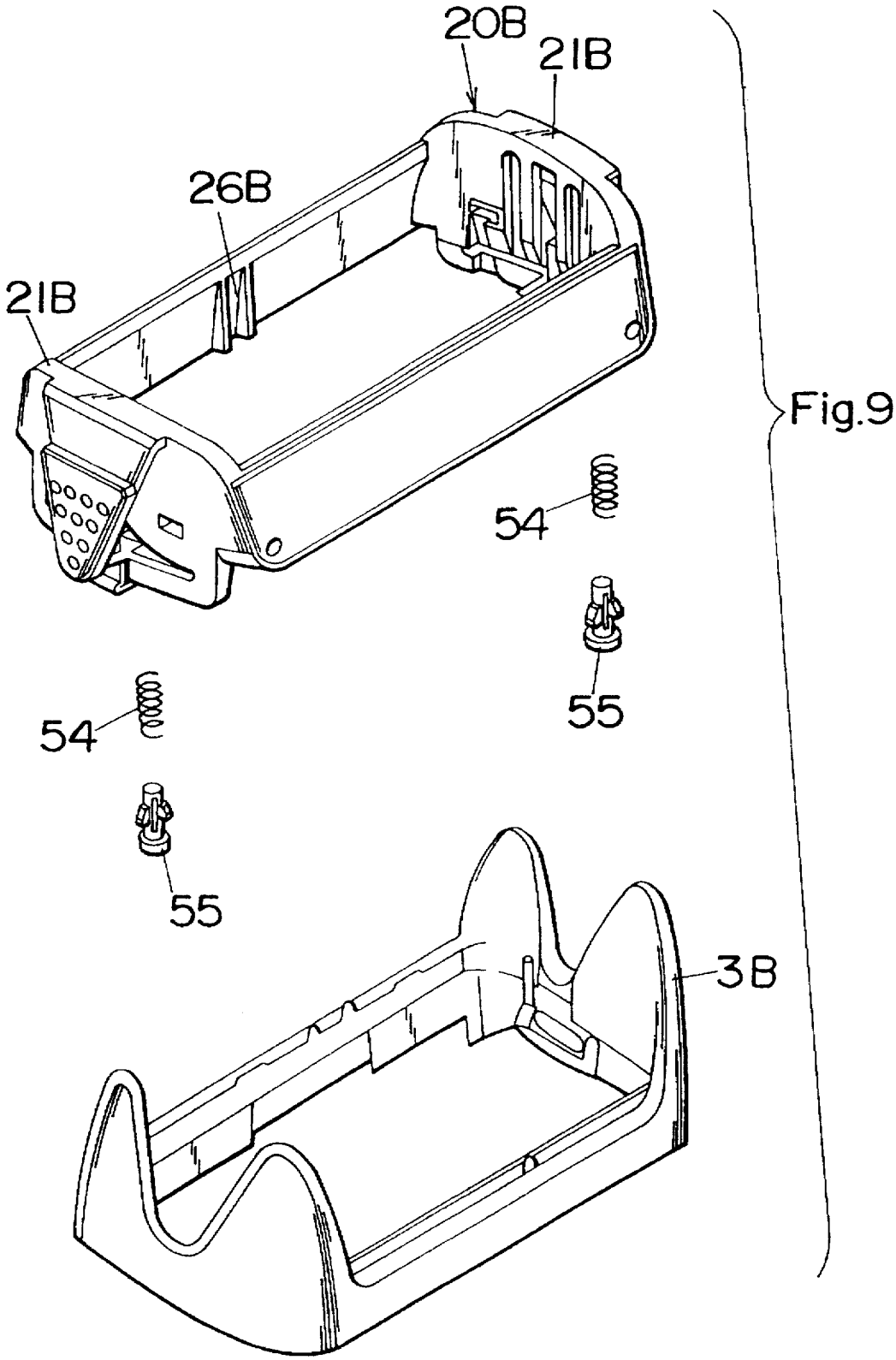
FIG. 9 is an exploded perspective view of the shaving head with cutter units removed therefrom.

In the present embodiment, the second cutter unit 50B is floatingly supported to the head frame 20B by separate springs 54, as shown in FIG. 9. The spring 54 is held between an anchor pin 55 secured to the lower center end of the end wall 21A of the head frame 20B and a shoulder 56 formed on a support 52B of the cutter unit 50B, as shown in FIG. 10. The supports 52B are connected to the end walls of the head frame 20B to movably hold the outer cutter 50B.

Also in this embodiment, the upward bias developed from the resilient beams 80 is selected to be less than an added bias of the resilient beams 35B and the spring 43B such that the skin stretcher 70B is depressed easier than the cutter unit 30B. Further, the bias of the springs 54 for floatingly support the second cutter unit 50B to the head frame 20B is selected to be less than the added bias of the resilient beams 35B and the spring 43B such that the cutter unit 50B is depressed easier than the cutter unit 30B.

Figure 12:
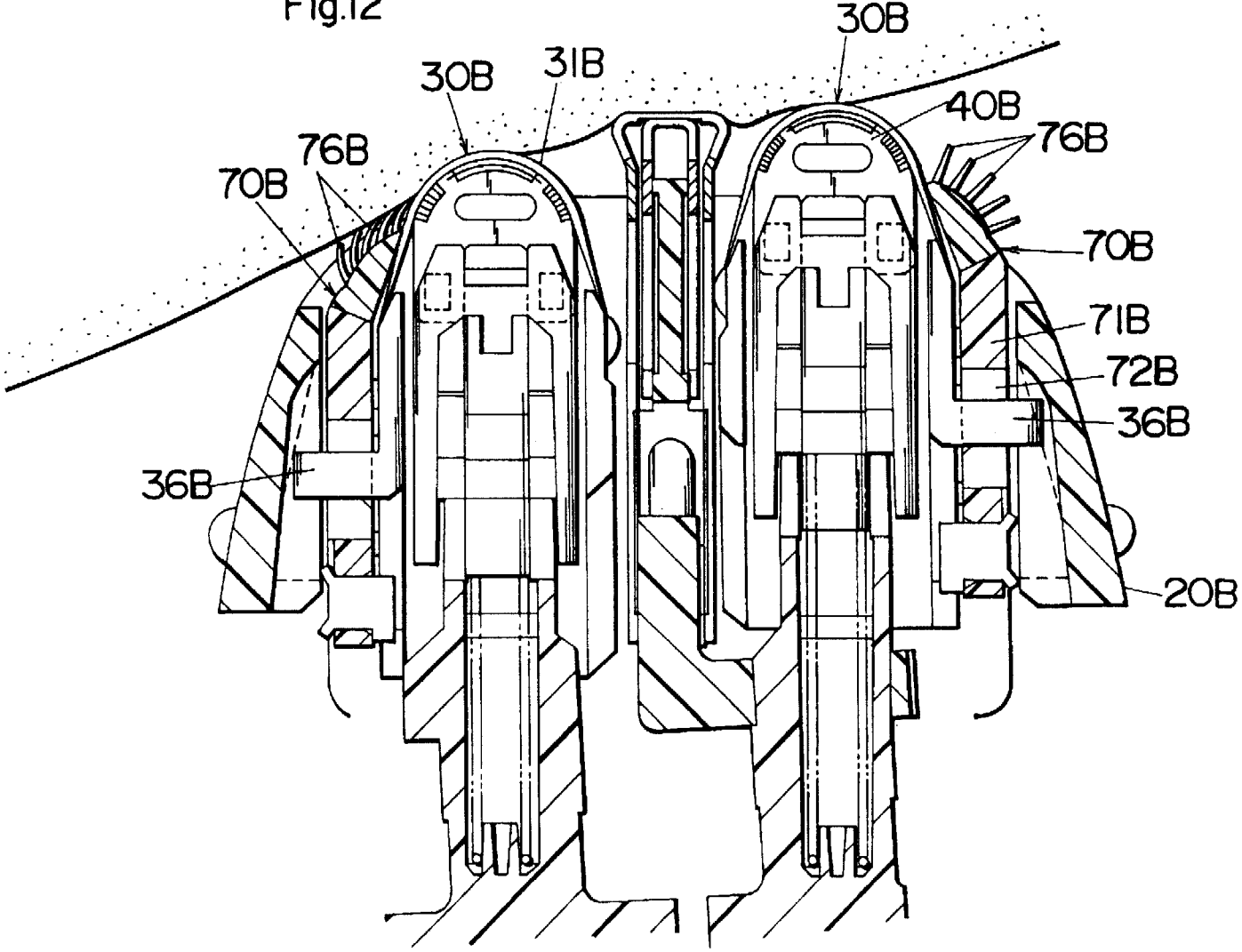
FIG. 12 is a vertical section illustrating the operation of the shaving head.

In operation, when the shaving head is moved across the skin with the skin stretcher 70B forwardly of the cutter unit 30B in the moving direction, as shown in FIG. 12, the fins 76B are resiliently bent towards the outer cutter 31B to keep the hairs raised until they are fed to the perforations of the outer cutter 31B.

Figure 13:
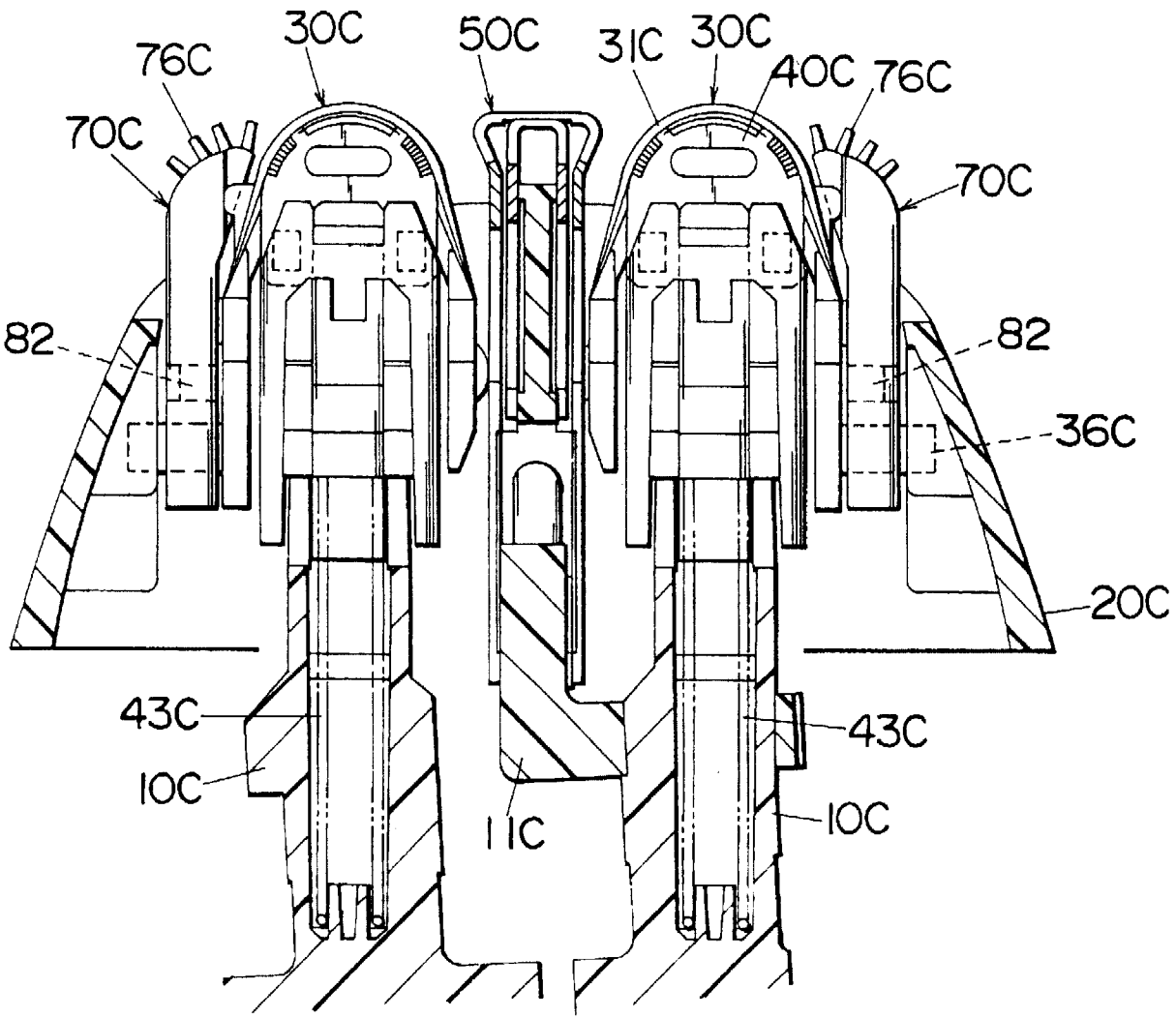
FIG. 13 is a vertical section which is similar to FIG. 8 but illustrates a shaving head in accordance with a third embodiment of the present invention.
Figure 14:
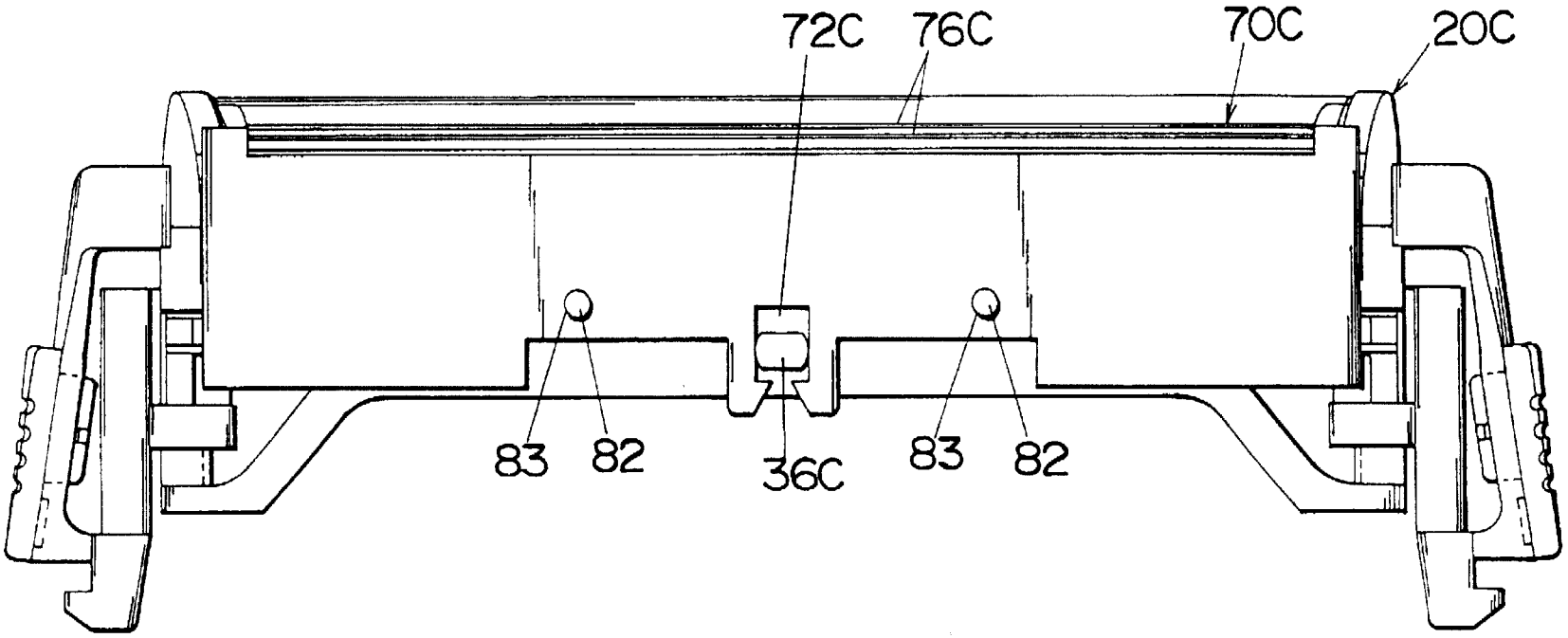
FIG. 14 is a front view illustrating the skin stretcher mounted to the shaving head with a portion of the head frame removed.

Third Embodiment <FIGS. 13 and 14>

A third embodiment of the present invention is similar to the first embodiment except that a like skin stretcher 70C is fixed to a holder 32C of a like cutter unit 30B to be movable together therewith relative to the head frame 20C. To this end, the holder 32C includes pins 82 which fits tightly into corresponding holes 83 formed in the skin stretcher 70C. Like parts are designated by like numerals with a suffix letter of "C".

Figure 15:
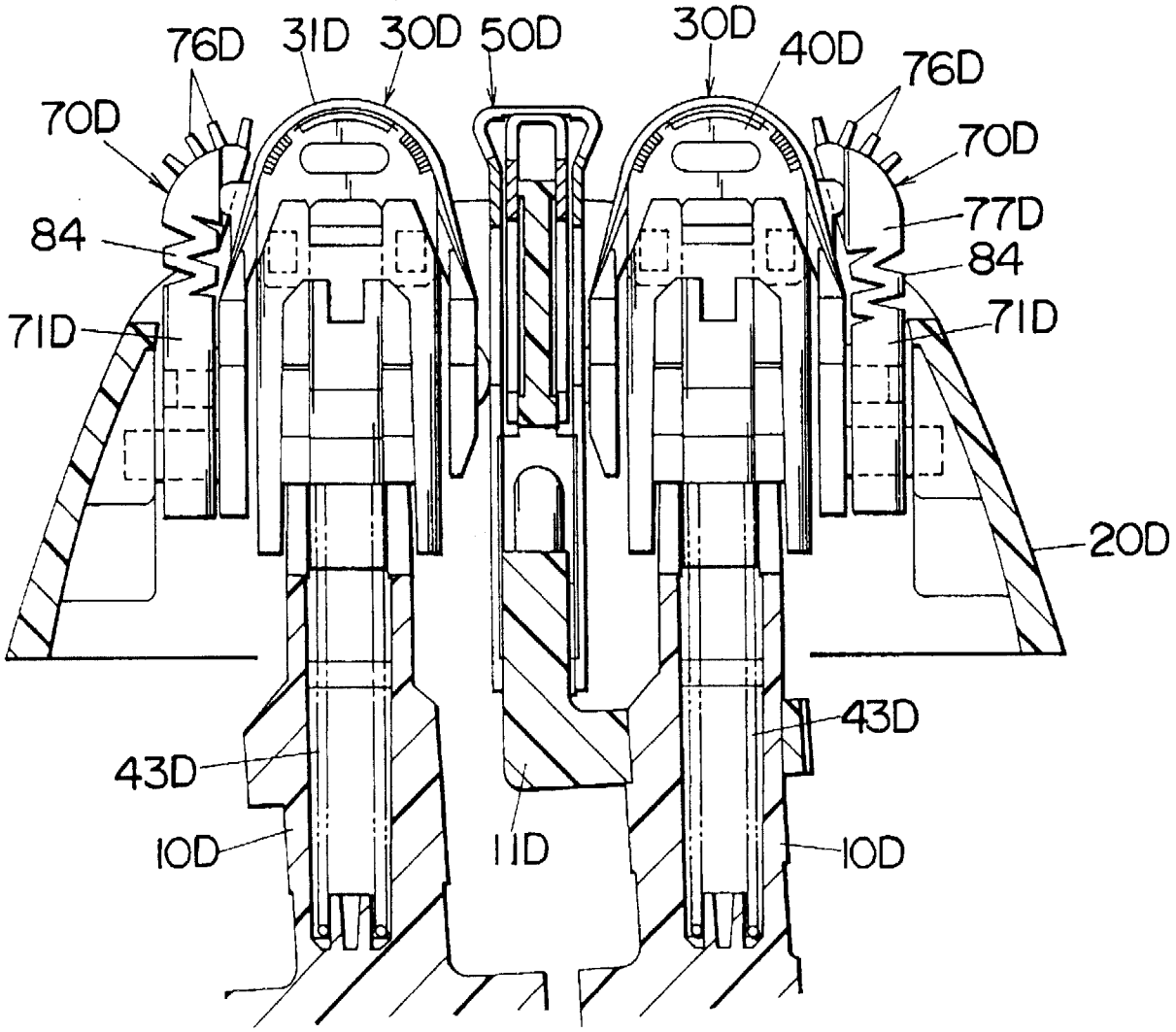
FIG. 15 is a vertical section which is similar to FIG. 8 but illustrates a shaving head in accordance with a fourth embodiment of the present invention.

Fourth Embodiment <FIGS. 15>

FIG. 15 illustrates a fourth embodiment of the present invention which is similar to the third embodiment except that a skin stretcher 70D is formed to have an integral spring member 84 by which fins 76D are floatingly supported to the associated cutter unit 30D. Like parts are designated by like numerals with a suffix letter of "D". The skin stretcher 70D comprises a base 71D, the spring member 84, and a header 77D with a plurality of fins 76D, which are molded integrally into a single structure. The spring member 84 is in the form of a living bellows giving enough resiliency by which the header 77D with the fins 76D can be depressed to a limited extent relative to the base 71D, i.e., the cutter unit 30D. Also in this embodiment, the upward bias developed from the spring member 84 is selected to be less than an added bias of the resilient beams 35D and the spring 43D for urging the outer cutter 31D such that the skin stretcher 70D is depressed easier than the cutter unit 30D.

Figure 16:
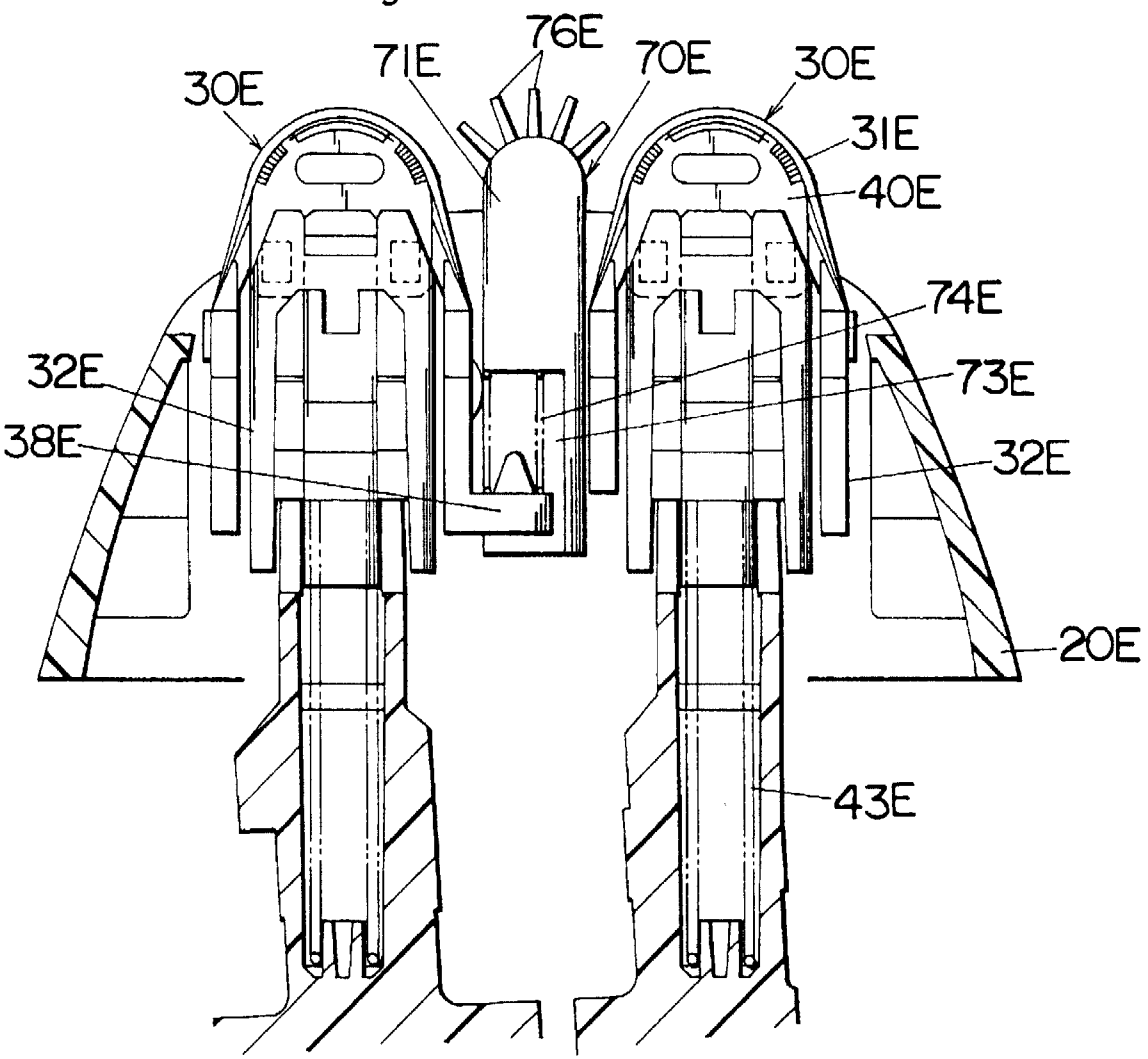
FIG. 16 is a vertical section which is similar to FIG. 8 but illustrates a shaving head in accordance with a fifth embodiment of the present invention.

Fifth Embodiment <FIG. 16>

FIG. 16 illustrates a fifth embodiment of the present invention which is similar to the first embodiment except that a like skin stretcher 70E is disposed between the cutter units 30E instead of the second cutter unit 50. Like parts are designated by like numerals with a suffix letter of "E". The skin stretcher 70E is urged upwardly by springs 74E which is held between the upper edges of recesses 73E and ledges 38E extending inwardly from the lower end of the holder 32E of the associated cutter unit 30E. The skin stretcher 70E is formed to have the plural fins 76E which project in such directions as to be capable of feeding the raised hairs to either of the two cutter units 30E. The spring 74E is selected to give an upward bias which is less than the bias for urging the outer cutter 31E such that the skin stretcher 70E is depressed easier than the cutter unit 30E.

Figure 17:
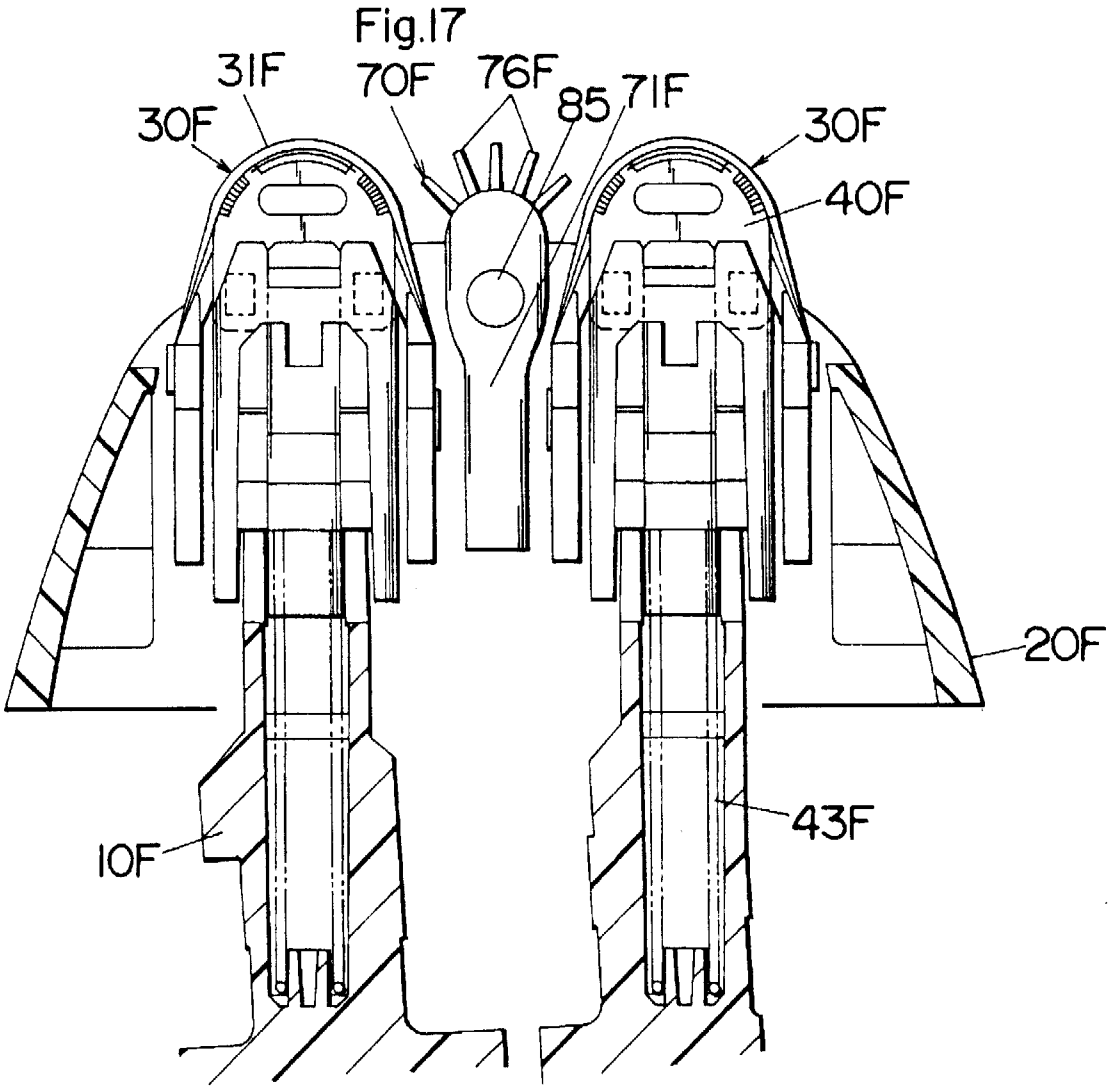
FIG. 17 is a vertical section which is similar to FIG. 8 but illustrates a shaving head in accordance with a sixth embodiment of the present invention.
Figure 18:
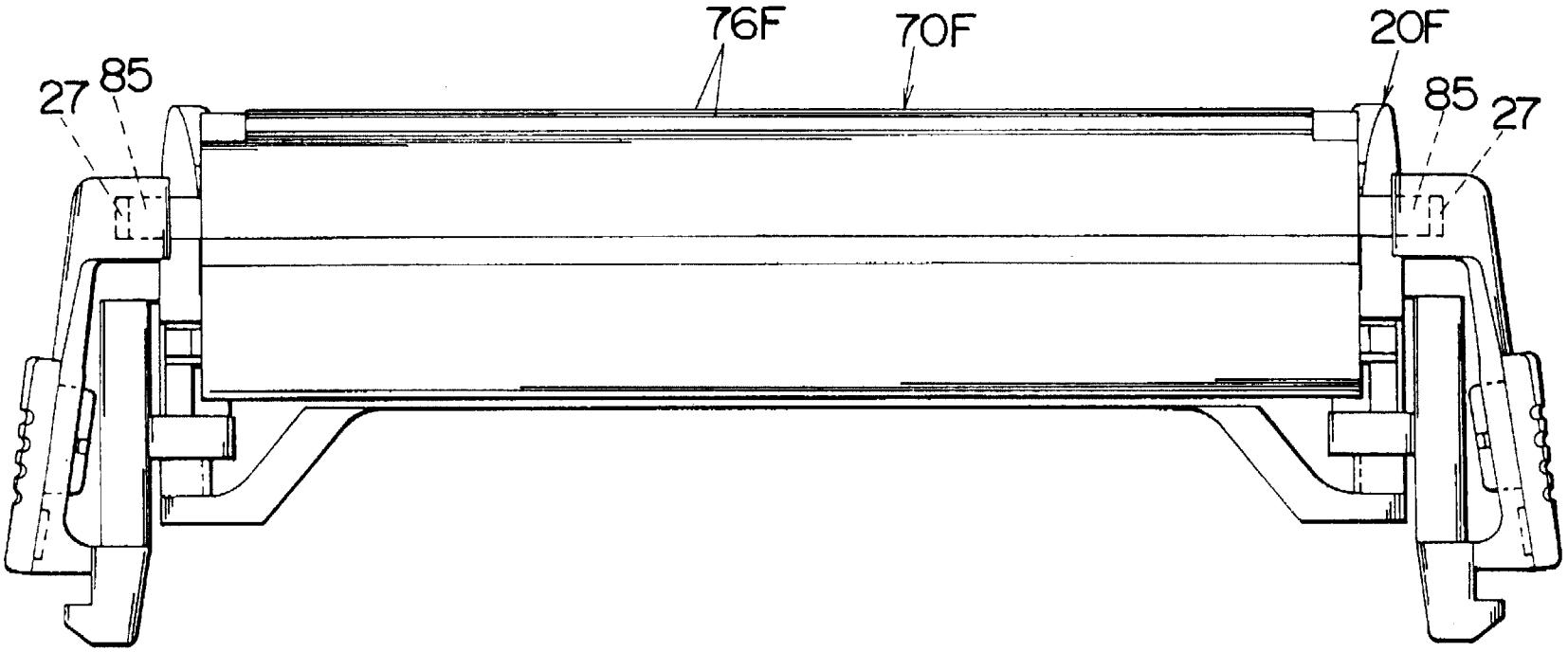
FIG. 18 is a front view illustrating the skin stretcher mounted to the shaving head with a portion of the head frame removed.

Sixth Embodiment <FIGS. 17 and 18>

FIGS. 17 and 18 illustrate a sixth embodiment of the present invention which is similar to the fifth embodiment except that the skin stretcher 70F is pivotally supported to the head frame 20F, rather than being floatingly supported thereto. Like parts are designated by like numerals with a suffix letter of "F". The skin stretcher 70F includes a pair of pivot pins 85 which project from opposite longitudinal ends thereof and are received in corresponding bearing holes 27 so that the skin stretcher 70F is swingable about a longitudinal axis of the head frame 20F, i.e., the longitudinal axis of the cutter units 30F.

Figure 19:
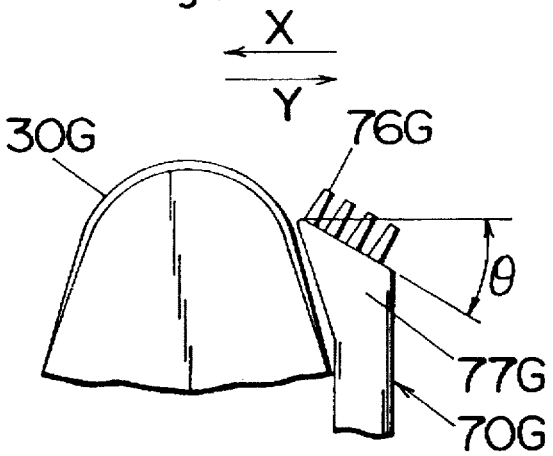
FIGS. 19, 20, and 21 are schematic views respectively illustrating modified skin stretchers which may be utilized in any of the embodiments.
Figure 20:
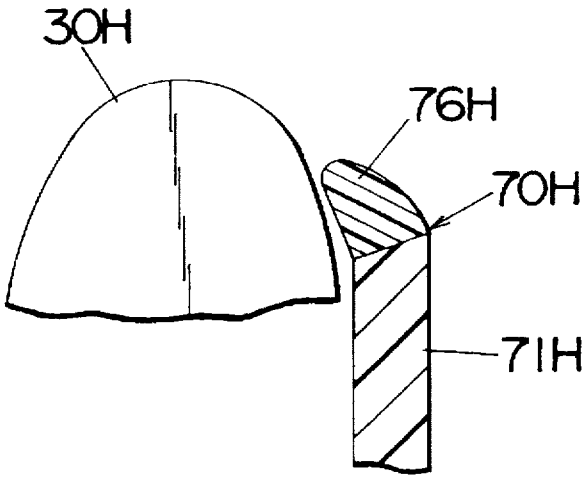
Figure 21:
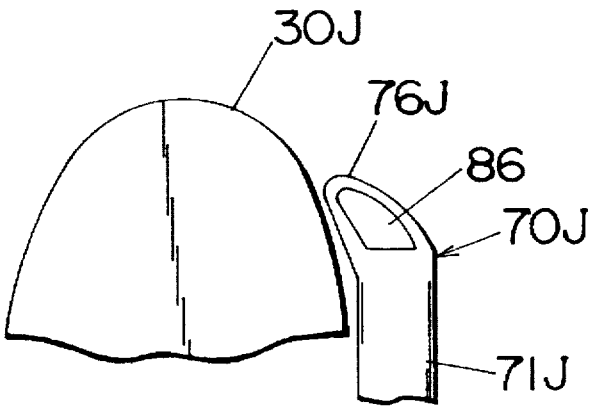

Modifications of skin stretcher <FIGS. 19 to 21>

FIGS. 19 to 21 illustrate modifications of the skin stretcher which can be adapted to any one of the above embodiments. FIG. 19 illustrates a modification in which the skin stretcher 70G comprises a plurality of parallel fins 76G of equal vertical length projecting at a right angle from an inclined top surface of a header 77G. The top surface of the header is inclined at an angle of θ such that the fins 76G come into contact with the skin with more resistance when the cutter unit 30G moves in a direction indicated by an arrow Y than moving in the opposite direction X. As the angle θ becomes greater, the fins 76G has less hair raising effect but with a smoother skin contact. Taking this into consideration, the angle θ is selected to be between 10° to 45° to combine sufficient hair raising effect and smooth skin contact.

FIG. 20 illustrates another modification in which a skin stretcher 70H comprises a base 71H and a rounded skin contact 76H which are molded integrally into a single structure. The skin contact 76H is made of an elastomer and inclined towards the associated cutter unit 30H, while the base 71H is made from a hard plastic and is supported to the cutter unit 30H.

FIG. 21 illustrates a further modification in which a skin stretcher 70J comprises a base 71J and a rounded skin contact 76J which are molded integrally into a single structure. The skin contact 76J made from an elastomer is inclined towards the associated cutter unit 30J and is formed with a cavity 86 to give enough resiliency to a thin wall portion around the cavity. The base 71J is made from a hard plastic and is supported to the cutter unit 30J.

Figure 22:
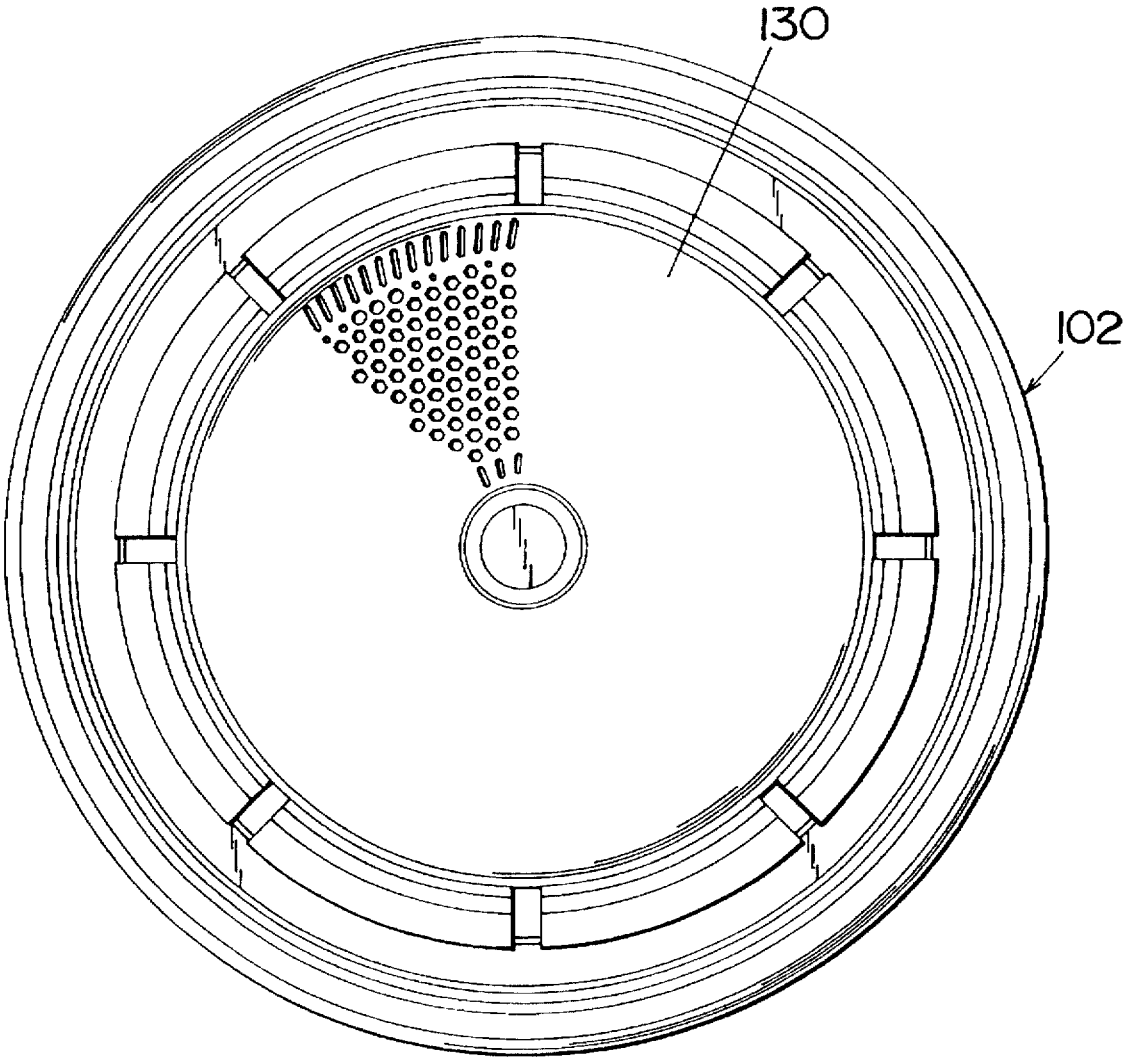
FIG. 22 is a top view of a shaving head in accordance with a seventh embodiment of the present invention.
Figure 23:
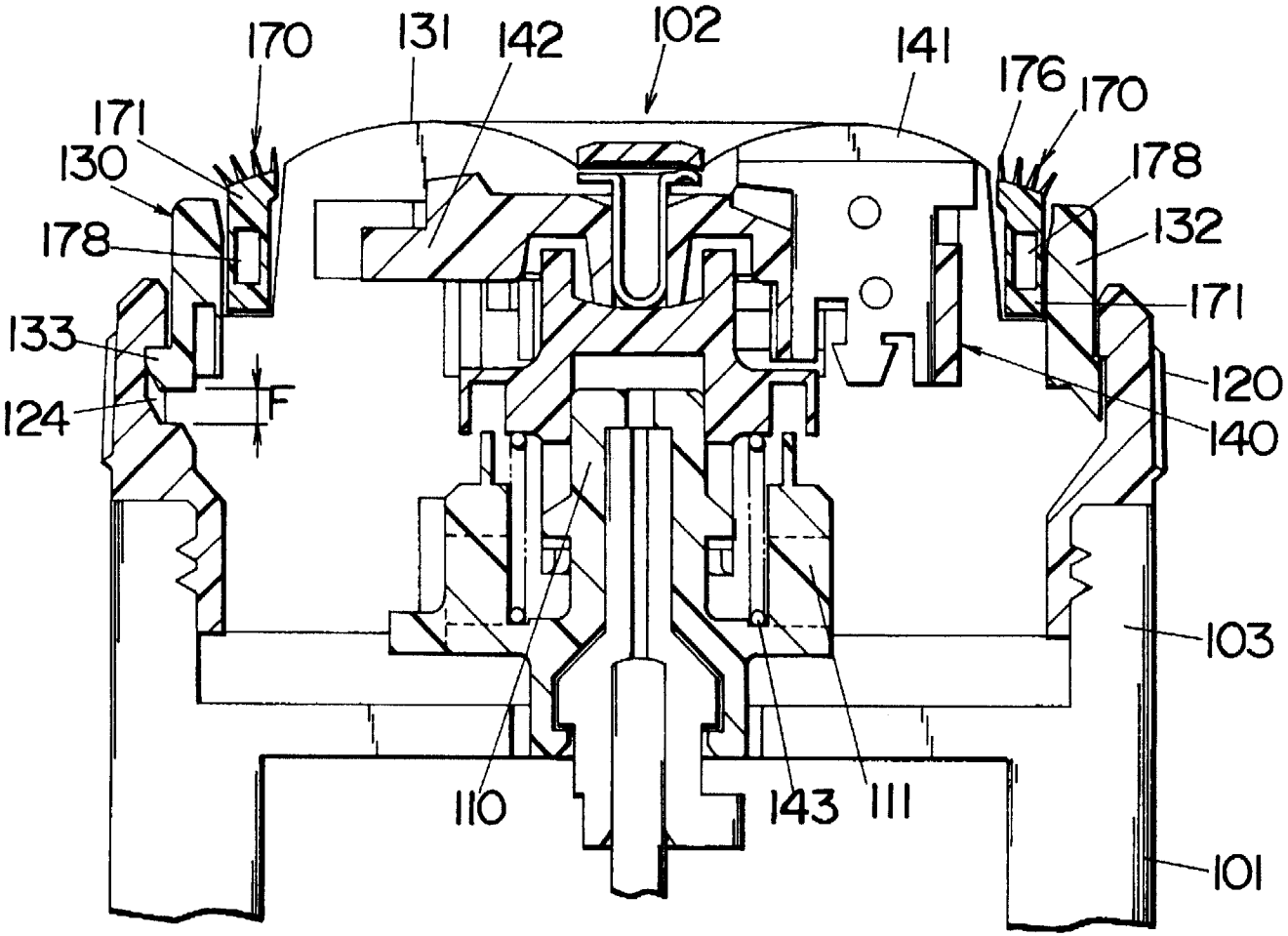
FIG. 23 is a vertical section of the shaving head.

Seventh Embodiment <FIGS. 22 and 23>

Referring to FIGS. 22 and 23, there is illustrated a shaving head in accordance with a seventh embodiment of the present invention. The shaving head 102 is of a circular configuration having a single cutter unit 130 which comprises an outer cutter 131 in the form of a circular foil with perforations and an annular holder 132 surrounding the outer cutter 131. The holder 132 is supported to a head frame 120 secured to a head support 103 at the top of a shaver body 101 to be vertically movable relative to the head frame 120 by a distance F. An inner cutter 140 comprises blades 141 supported on a disk 142 which is coupled to a drive pin 110 connected to an rotary output shaft of an incorporated motor. A spring 143 is held between the disk 142 and a flange 111 of the drive pin 110 to urge the blades 141 against the outer cutter 131 to give a suitable contacting pressure therebetween and consequently urge the head frame 120 upwardly until a stopper 133 of the holder 132 is engaged with an upper edge of a vertical slot 124 in the inner surface of the head frame 120. Thereby, the holder 132 is floatingly supported to the head frame 120 to be capable of depressed by the distance F relative to the shaver body 101.

Surrounding the outer cutter 131 is an annular skin stretcher 170 which is held by the holder 132 and comprises a plurality of fins 176 integrally projecting from a base 171. The base 171 is formed to have a cavity 178 by which the upper portion of the base is resiliently movable relative to the lower portion secured to the head frame 120. Thus, the upper portion of the skin stretcher 170 can be depressed by a limited extent relative to the cutter unit 130. In this embodiment, the skin stretcher itself can be movable relative to the shaver body 101 by a macro displacement structure of floatingly supporting the head frame 132, i.e., the cutter unit 130 to the shaver body 101 and/or of movably holding the upper portion of the skin stretcher 170 relative to the lower portion. The fins 176, which undertake a micro displacement relative to the base in conformity with the skin of the user, are formed to have some breaks along its circumference so as to be easy to flex in a direction of maximizing the hair raising effect.

Figure 24:
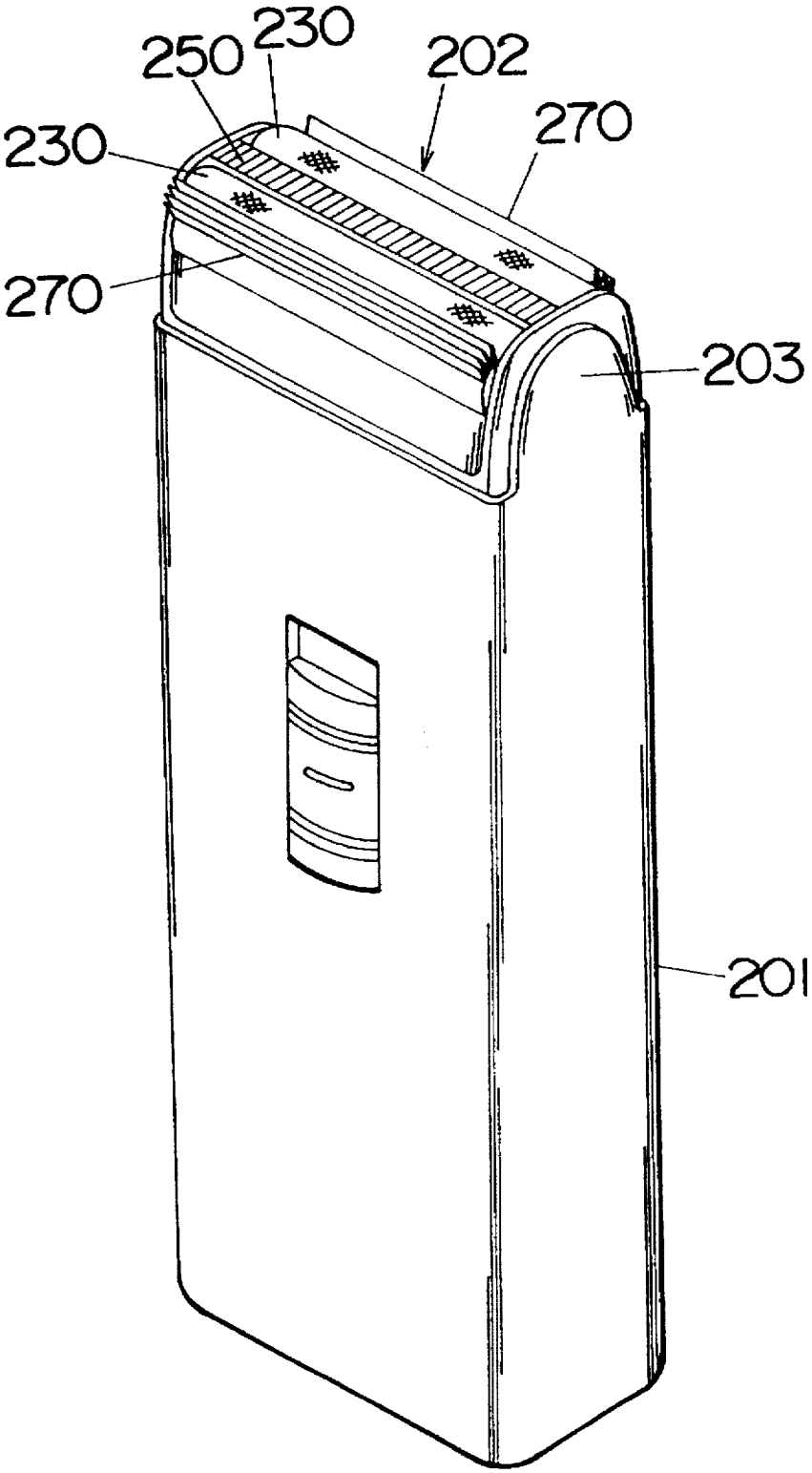
FIG. 24 is a perspective view of a dry shaver in accordance with an eighth embodiment of the present invention.
Figure 25:
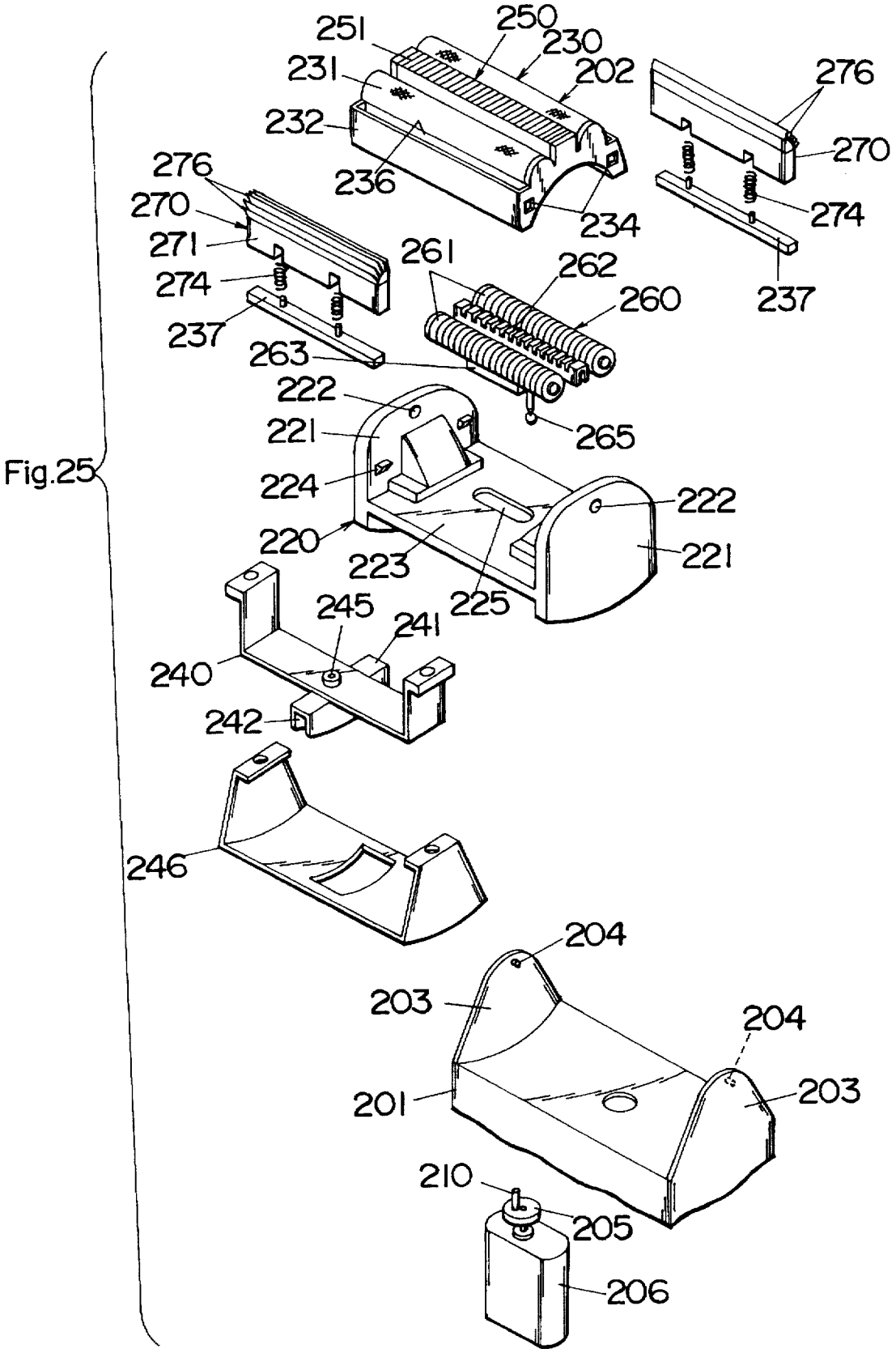
FIG. 25 is an exploded perspective view of a shaving head of the shaver.

Eighth Embodiment <FIGS. 24 and 25>

Referring to FIGS. 24 and 25, there is illustrated a dry shaver in accordance with an eighth embodiment of the present invention. The dry shaver comprises a swingable shaving head 202 mounted on a shaver body 201. The shaving head 202 comprises a pair of first cutter units 230 for cutting short hairs and a second cutter unit 250 for cutting relatively long hairs. Each of first cutter unit 230 includes an outer cutter 231 in the form of an elongated perforated foil curved into a generally U-shaped configuration. The second cutter unit 250 includes an elongated outer cutter 251 with a number of longitudinally spaced slits. The outer cutters 231 and 251 of the first and second cutter units 230 and 250 are supported together on a common holder 232 with the outer cuter 251 disposed in parallel between the outer cutters 231. The holder 232 is supported to a head frame 220 having a flat bottom wall 223 and opposed end walls 221. Latch projections 224 are formed on inner surfaces of the end walls 221 for latching engagement into corresponding holes 234 of the holder 232 for detachably supporting the holder 232 to the head frame 220. The head frame 220 is disposed between opposed end flanges 203 projecting on top of the shaver body 201 with pivot pins 204 on the end flanges 203 fitted into bearing holes 222 so that the head frame 220 can swing together with a reciprocator 240 about a pivot axis which extends in parallel with the longitudinal axes of the outer cutters 231 and 251. Thus, the shaving head 202 is allowed to swing so that the outer cutters 231 and 251 are easy to come into contact with the skin for effective shaving.

The reciprocator 240 is slidably mounted to the bottom of the head frame 220 to be movable along the length of the head frame 220 together with a bottom cover 246 closing the bottom of the head frame 220. The reciprocator 240 is formed at its longitudinal center with a guide 241 having a bottom-open channel 242 which extends transversely of the head frame 220 for receiving a drive pin 210 projecting through the bottom cover 246 from the top of the shaver body 201. The drive pin 210 is connected through an eccentric cam 205 to an output rotor shaft of a motor 206 incorporated within the shaver body 201 so that the eccentric rotary motion of the drive pin 210 is translated into reciprocatory motion of the reciprocator 240. The reciprocator 240 has a catch 245 for detachably receiving a joint pin 265 of an inner cutter block 260 through a slot 225 in the bottom of the head frame 220 to reciprocate the inner cutter block. The inner cutter block 260 comprises a carrier 263 for a pair of first inner cutters 261 to be in hair shearing engagement respectively with the outer cutters 231 and a stem (not seen) for connection with a second inner cutter 262 to be in hair shearing engagement with the outer cutter 251.

A pair of hair stretchers 270 are supported to the holder 232 and therefore to the head frame 220 in a manner that they extend along substantially the entire length of the outer cutters 231 adjacent outwardly thereof. Each hair stretcher 270 comprises a skin contact 276 integrally molded with a base 271. The skin contact 276 comprises a plurality of parallel elastic fins 276 of the same configuration as in the first embodiment for raising the hairs immediately before the hairs are fed into the perforations of the outer cutter 231 to be cut. The base 271 is vertically movable within a pocket 236 in either side of the holder 232 and is biased upwardly by springs 274 held between the base 271 and a bar 237 secured to the holder 232. Thus, the skin stretcher 270 is floatingly supported to the head frame 220 to be depressed to a limited extent relative to the adjacent outer cuter 231.

It is noted in this connection that the outer cutters 231 and 251 are held vertically movable by a slight extent relative to the holder 232 and that the inner cutter block 260 includes a spring (not seen) for biasing the inner cutters 261 and 262 against the outer cutters 231 and 251. Thus, the outer cutters 231 and 251 are capable of being depressed against the bias of the spring. The biasing force of the skin stretcher 270 is selected to be less than the biasing force for the outer cutters 231 and 251 so that the skin stretcher 270 is firstly depressed when the shaving head is pressed against the skin.

In this embodiment, the skin contact 276 is capable of undertaking a macro displacement relative to the shaver body 201 due to the swinging movement of the head frame 220 as well as the vertical movement of the skin stretcher 270 relative to the head frame 220, while the skin contact 276 can itself undertake a minor displacement due to its elastic nature. With the macro and micro displacements, the skin contact 276 can follow the skin contour for effective hair raising and shaving.

Figure 26:
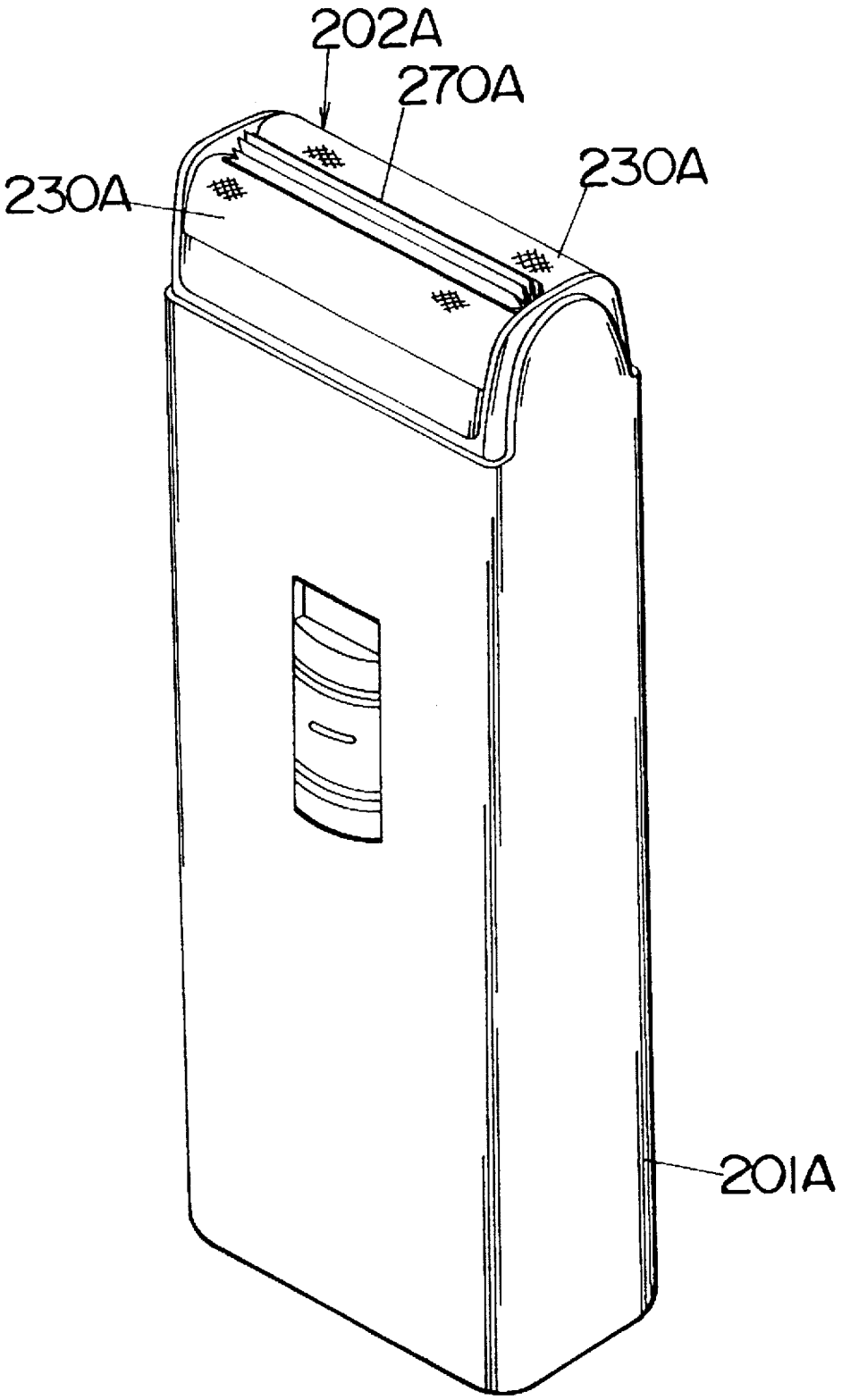
FIG. 26 is a perspective view of a dry shaver in accordance with a ninth embodiment of the present invention.
Figure 27:
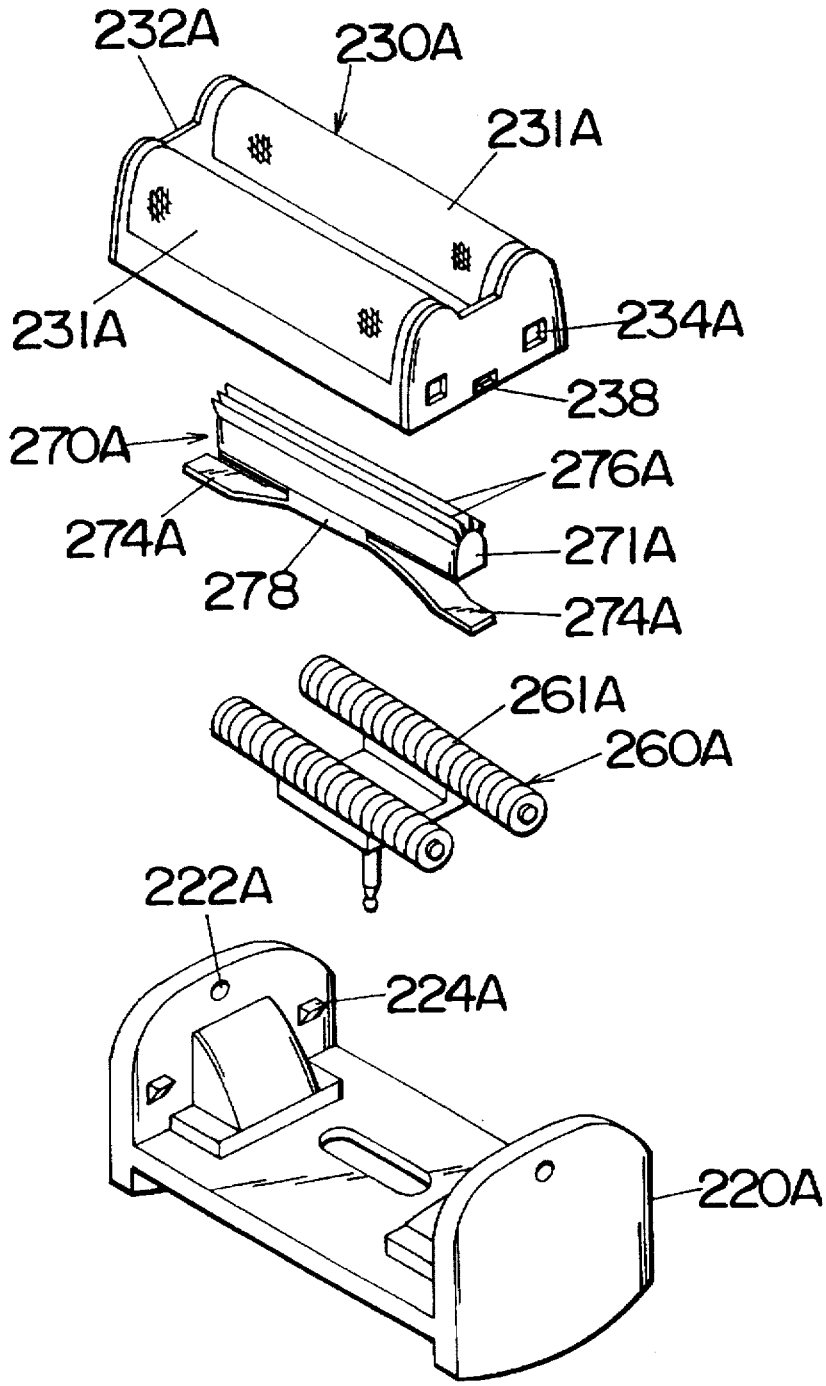
FIG. 27 is an exploded perspective view of a shaving head of the shaver.

Ninth Embodiment <FIGS. 26 and 27>

FIGS. 26 and 27 illustrate a ninth embodiment of the present invention which is similar to the eighth embodiment except that a single skin stretcher 270A is disposed between the two outer cutters 231A, i.e., cutter units 230A. Like parts are designated by like numerals with a suffix letter of "A". The skin stretcher 270A is floatingly supported together with the outer cutters 231A to a like holder 232A which is detachably mounted to a head frame 220A by engagement of latch projections 224A of the head frame 220A with corresponding holes 234A in the holder 232A. The head frame 220A is supported to the shaver body 201A to be swingable about a longitudinal axis of the head frame 220A in the same manner as in the eighth embodiment. The skin stretcher 270A comprises a base 271A with a plurality of elastic fins 276A defining the skin contact and a pair of resilient legs 274A extending from a rigid member 278 at the lower center of the base 271A. The ends of the resilient legs 274A are fitted into corresponding holes 238 in the end walls of the holder 232A so that the skin stretcher 270A is biased upwardly. The upper end of the skin stretcher 270A, i.e., the elastic fins 276A are kept at a higher level than the upper ends of the outer cutters 231A in the absence of an external depressive force. Also in this embodiment, the skin contact, i.e., the elastic fins can undertake a macro displacement relative to the shave body 201A due to swinging movement of the head frame 220A as well as the vertical movement of the skin stretcher 270A relative to the head frame 220A, while the elastic fins 276B can undertake a micro displacement due to the elastic nature that the fins inherently have.

Figure 28:
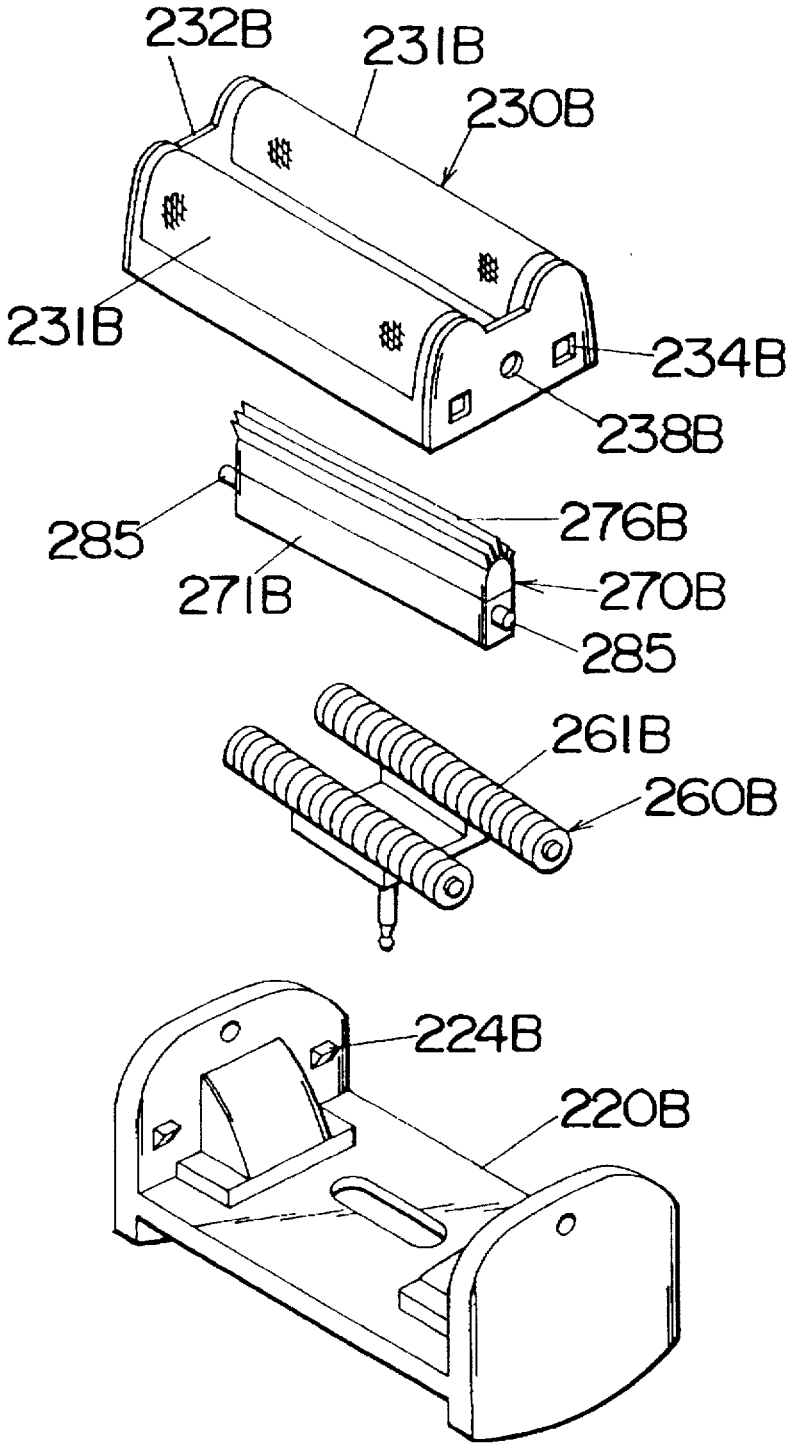
FIG. 28 is an exploded perspective view of a shaving head in accordance with a tenth embodiment of the present invention.

Tenth Embodiment <FIG. 28>

FIG. 28 illustrates a tenth embodiment of the present invention which is similar to the eighth embodiment except that a single skin stretcher 270B is disposed between the two outer cutters 231B, i.e., cutter units 230B to be swingable relative to a head frame 220B. Like parts are designated by like numerals with a suffix letter of "B". The skin stretcher 270B is supported together with the outer cutters 231B to a like holder 232B detachably mounted to the head frame 220B which is in turn supported to the shaver body 201B to be swingable about a longitudinal axis of the head frame 220B in the same manner as in the eighth embodiment. The skin stretcher 270B comprises a base 271B with a plurality of elastic fins 276B defining the skin contact and a pair of pivot pins 285 on opposite ends of the base 271B. The pivot pins 285 are received into corresponding bearing holes 238B in the end walls of the holder 232B so that the skin stretcher 270A is swingable about an axis parallel to the longitudinal axis of the outer cutters 231B.

In this embodiment, a macro displacement of the skin contact, i.e., the elastic fins 276B relative to the shave body 201B is achieved by the swinging movement the head frame 220B and the swinging movement of the skin stretcher 270B itself relative to the head frame 220B, while a micro displacement of the elastic fins 276B is achieved by the elastic nature of the fins.

Figure 29:
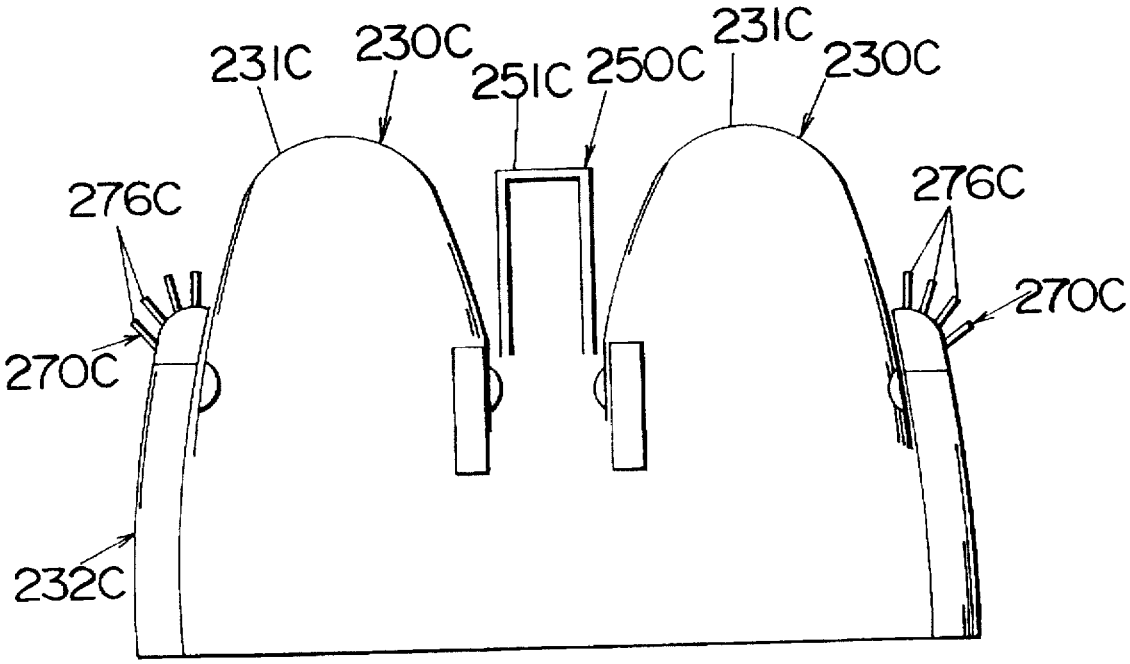
FIG. 29 is a schematic view illustrating a shaving head in accordance with an eleventh embodiment of the present invention.

Eleventh Embodiment <FIG. 29>

FIG. 29 illustrates an eleventh embodiment of the present invention which is similar to the eighth embodiment except that skin stretchers 270C are integrally molded with a holder 232C which carries outer cutters 231C and 251C. The holder 232C is detachably to a like head frame (not shown) which is supported to a shaver body (not shown) to be swingable about an axis parallel to the longitudinal axis of the outer cutters 231C. The skin stretcher 270C is molded integrally with the holder 232C but with different material. That is, the skin stretcher 270C is made from an elastic material, while the holder 232C is made from a rigid plastic material. The skin stretcher 270C comprises a plurality of fins 276C integrally extending from a header 277C in the same manner as in the first embodiment.

In this embodiment, a macro displacement of the elastic fins 276C relative to the shave body is achieved by the swinging movement the head frame, while a micro displacement of the elastic fins 27C is achieved by the elastic nature of the fins.

What is claimed is:

1. A dry shaver comprising:

a shaver body;

a shaving head mounted on top of said shaver body, said shaving head including at least one cutter unit with a perforated outer cutter;

an inner cutter driven to move in shearing contact with said outer cutter; and a skin stretcher mounted to said shaving head adjacent to said outer cutter and extending along the periphery of said outer cutter, said skin stretcher adapted in use for contact with skin of a user in order to raise hairs to be subsequently introduced into perforations of said outer cutter;

said skin stretcher comprising a skin contact means elongated along the periphery of the outer cutter and a base carrying said skin contact means; and macro displacement means being provided to allow said skin contact means to be movable within a macro displacement range relative to said skin contact;

wherein said skin contact means is of elastic nature capable of being elastically deformed within a micro displacement range relative to said base, said skin contact means comprising a plurality of parallel elastic fins extending along the periphery of said outer cutter and the fin located nearer to said outer cutter having an upper end which is higher than the upper end of a fin located away from said outer cutter.

2. A dry shaver as set forth in claim 1, wherein said fins project at different angles from one another.

3. A dry shaver as set forth in claim 1, wherein said shaving head includes a head frame which is mounted at an upper end of said shaver body, and wherein said macro displacement means comprises spring means which support the base of said skin stretcher floatingly to said head frame so that said skin contact means is allowed to be movable relative to said head frame and said shaver body within said macro displacement range.

4. A dry shaver as set forth in claim 1, wherein said shaving head includes a head frame which is mounted at an upper end of said shaver body, and wherein said cutter unit is floatingly supported to said head frame, the base of said skin stretcher being secured to said cutter unit to be depressed together therewith, said macro displacement means comprising spring means for floatingly supporting said cutter unit to said head frame such that said skin contact is movable relative to said head frame and said shaver body within said second displacement range.

* * * * *